United States Patent [19]

Heckert et al.

[11] 4,005,030

[45] Jan. 25, 1977

[54] ORGANOSILANE-CONTAINING ANIONIC DETERGENT COMPOSITION

[75] Inventors: David C. Heckert, Oxford; David M. Watt, Jr., Cincinnati, both of Ohio

[73] Assignee: The Procter & Gamble Company, Cincinnati, Ohio

[22] Filed: Apr. 22, 1975

[21] Appl. No.: 570,533

[52] U.S. Cl. ..... 252/140; 252/139; 252/DIG. 15; 252/89 R; 252/531; 260/448.2 N; 260/448.8 R

[51] Int. Cl.[2] ..... C11D 3/12; C11D 7/10

[58] Field of Search ..... 260/448.2 N, 448.8 R, 260/448.2 E, 448.2 Q; 252/94, 140, 139, DIG. 15, 531, 89

[56] References Cited

UNITED STATES PATENTS

| | | | |
|---|---|---|---|
| 3,389,160 | 6/1968 | Reid | 260/448.2 N |
| 3,557,178 | 1/1971 | Gölitz | 260/448.2 N |
| 3,624,120 | 11/1971 | Yetter | 260/448.2 E |
| 3,658,867 | 4/1972 | Prokai | 260/448.2 N |

FOREIGN PATENTS OR APPLICATIONS

| | | | |
|---|---|---|---|
| 882,053 | 10/1957 | United Kingdom | 260/448.2 N |
| 686,068 | 4/1959 | United Kingdom | 260/448.2 N |

*Primary Examiner*—Mayer Weinblatt
*Attorney, Agent, or Firm*—C. R. Wilson; R. B. Aylor; T. H. O'Flaherty

[57] ABSTRACT

A detergent composition containing an anionic detergent and an organosilane is capable of imparting soil release benefits to hard surfaces washed therewith. Soil adheres to such surfaces less strongly thereby making them easier to clean. The detergent composition can be formulated for use in a wide range of applications, e.g., as a light duty liquid composition, car wash composition, oven cleaner, window cleaner or toilet bowl cleaner.

26 Claims, No Drawings

ORGANOSILANE-CONTAINING ANIONIC DETERGENT COMPOSITION

BACKGROUND OF THE INVENTION

This invention relates to a detergent composition containing an anionic detergent and an organosilane compound. The detergent compositions of this invention are intended for use on hard, i.e., metallic and vitreous surfaces. More particularly, the inclusion of the hereindescribed organosilane compound in detergent compositions provides soil release benefits to surfaces washed with such compositions.

Detergent compositions intended for use on hard surfaces are continually being reformulated in order to improve their performances. Generally, detergent compositions are formulated to obtain optimum cleaning performance. Such endeavors have revolved around the use of different organic detergents as well as the use of detergent builders and various additives, e.g., enzymes, bleaches and pH modifiers. Considerations such as human safety, compatibility of components, and equipment safety have played a part in dicatating what components are available for improving existing detergent compositions.

Other attempts at insuring that hard surfaces are clean have involved the application of various surface coatings to such hard surfaces. For example, cookware which has been coated with Teflon provides a surface which is easier to clean. Thus, while soil continues to deposit upon the surface, its removal is easier by virtue of the coating. Unfortunately, such coatings are relatively expensive. Moreover, such a coating on glassware would be objectionable due to its appearance and/or feel. Since this kind of a coating must be applied by the manufacturer of the cookware or glassware, it must be permanent. This generally involves a relatively heavy coating with the consequent drawback in terms of cost, appearance, and/or feel.

It has now been discovered that a very thin layer of a compound possessing soil release benefits can be supplied to metallic and vitreous surfaces by a detergent composition. Thus, when the detergent composition is used for cleaning or washing a hard surface, a thin semi-permanent coating of a compound is laid down. The amount of coating is sufficient to provide a soil release benefit to the surface, while at the same time, is not visible or expensive.

Commonly assigned copending patent application "Organosilane-Containing Detergent Composition", Heckert and Watt, U.S. Ser. No. 570,534, filed Apr. 22, 1975, discloses the addition of certain positively charged organo silanes to a detergent composition containing a nonionic, zwitterionic, or ampholytic detergent or mixtures thereof as the active detergent. It has been found that certain of these organosilanes are incompatible with anionic detergents. That is, the positively charged organosilane reacts with the negatively charged anionic detergent to effectively reduce the ability of the organosilane to impart soil release benefits to a hard surface.

It accordingly is an object of this invention to provide detergent compositions which are capable of imparting a soil release benefit to surfaces contacted therewith.

It is another object of this invention to provide detergent compositions containing an anionic detergent and an organosilane which is able to provide soil release benefits to metallic and vitreous surfaces when applied thereto from a wash or rinse solution.

As used herein, all percentages and ratios are by weight unless otherwise indicated.

SUMMARY OF THE INVENTION

A detergent composition capable of imparting soil release benefits to metallic and vitreous surfaces contacted therewith consisting essentially of:

a. an organosilane having the formula $$(R_1O)_{3-a}-\overset{(R_2)_a}{\overset{|}{Si}}-(CHR_3)_b-[O-CH_2-CHOH-CH_2]_c-\overset{R_4}{\overset{|}{\underset{R_4}{\underset{|}{Y^+}}}}-R_5\ X^-$$

or is a siloxane oligomer thereof wherein $R_1$ is an alkyl group containing 1 to 4 carbon atoms or $$Z(OC_xH_{2x})_m$$

where $x$ is 2 to 4, $m$ is 1 to 20, and Z is hydrogen, an alkyl group containing 1 to 3 carbons, or an acyl group containing 1 to 4 carbon atoms; $R_2$ is an alkyl group containing 1 to 12 carbon atoms; $a$ is 0 to 2; $R_3$ is hydrogen or an alkyl group containing 1 to 12 carbon atoms; $b$ is 1 to 3; $c$ is 0 or 1; $R_4$ is an alkyl, aryl or aryl alkyl group containing 1 to 12 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen; $R_5$ is an alkyl, aryl or arylalkyl group containing 1 to 12 carbon atoms; X is halide; and Y is nitrogen, sulfur, or phosphorus and the sum of the carbon atoms in $R_2$, $R_3$, and $R_5$ and $R_4$ when $R_4$ is alkyl, aryl, arylalkyl or carboxy-substituted alkyl does not exceed 20 carbon atoms; and b. a water-soluble organic anionic detergent in a weight ratio of organosilane to detergent of from 1:1 to 1:10,000.

DESCRIPTION OF THE INVENTION

The subject invention relates to all manner of detergent compositions. As examples, may be mentioned the following: light duty liquid detergent compositions, car wash detergent compositions, window cleaners, oven cleaners and toilet bowl cleaners. The previous listing is merely illustrative and is in no way limiting. Such compositions are further described hereinafter. The compositions may be used on any metallic or vitreous surface where a soil release benefit is desired. Examples of such surfaces are cooking utensils (e.g. metallic pots, pans and skilltes), tableware (e.g. china, glasses, ceramic ware and flatware), oven walls, windows, and porcelain surfaces (e.g. bathtubs, sinks, and toilet bowls).

The detergent compositions of this invention contain an organosilane and a water-soluble anionic detergent in a ratio of organosilane to anionic detergent of from 1:1 to 1:10,000, preferably 1:1 to 1:500, most preferably 1:3 to 1:60. The organosilane has the following formula:

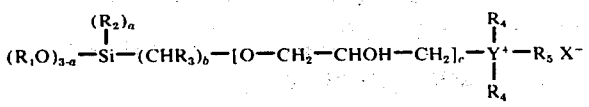

or is a siloxane oligomer thereof wherein $R_1$ is an alkyl group containing 1 to 4 carbon atoms or $$Z(OC_xH_{2x})_m$$

where $x$ is 2 to 4, $m$ is 1 to 20, and Z is hydrogen, an alkyl group containing 1 to 3 carbon atoms or an acyl group containing 1 to 4 carbon atoms; $R_2$ is an alkyl group containing 1 to 12 carbon atoms; $a$ is 0 to 2; $R_3$ is hydrogen or an alkyl group containing 1 to 12 carbon atoms; $b$ is 1 to 3; $c$ is 0 or 1; $R_4$ is an alkyl, aryl or arylalkyl group containing 1 to 12 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen; $R_5$ is an alkyl, aryl or arylalkyl group containing 1 to 12 carbon atoms; X is halide; Y is nitrogen, sulfur or phosphorus and the sum of the carbon atoms in $R_2$, $R_3$, $R_5$, and $R_4$ when $R_4$ is alkyl, aryl, arylalkyl or carboxy-substituted alkyl does not exceed 20. Preferably X is chloride or bromide and $b$ is 1 and the sums of $R_2$, $R_3$, $R_5$ and $R_4$ when $R_4$ is alkyl, aryl, arylalkyl or carboxy-alkyl does not exceed 15.

It should be understood that the $R_4$ in the above formula and the formulae to follow may be the same or different. It should further be understood that when Y is S, there will be only one $R_4$ substituent. Also, when one $R_4$ is oxygen or, under basic conditions, the anion of a carboxylic acid substituted alkyl, the counter ion $X^-$ is not extant. The 1 to 4 carbon atoms in the carboxy-substituted alkyl group is inclusive of the carboxyl group. The aryl and arylalkyl groups of $R_4$ and $R_5$ contain 6 to 12 carbon atoms.

Classes of organosilane compounds and their preparation which fit the above description follow.

I.

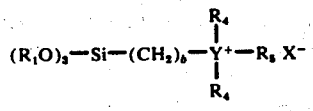

wherein $R_1$ is a $C_{1-4}$ alkyl group, $b$ is from 1–3, $R_4$ is a $C_{1-12}$ alkyl, aryl or arylalkyl group, a carboxy-substituted $C_{1-4}$ alkyl group, $$(C_xH_{2x}O)_mZ$$

where $x$ is 2–4, $m$ is 1–20, and Z is hydrogen, a $C_{1-3}$ alkyl group or a $C_{1-14}$ acyl group, or oxygen provided only one $R_4$ is oxygen, $R_5$ is a $C_{4-12}$ alkyl, aryl or arylalkyl group, X is a halide, Y is N, S or P, and the sum of the carbon atoms in $R_5$ and $R_4$ when $R_4$ is alkyl, aryl, arylalkyl or carboxy-substituted alkyl does not exceed 20.

When $b$ is 3 and $R_4$ is a $C_{1-12}$ alkyl, aryl or arylalkyl group, the class of compounds represented by Formula I is prepared by the following route:

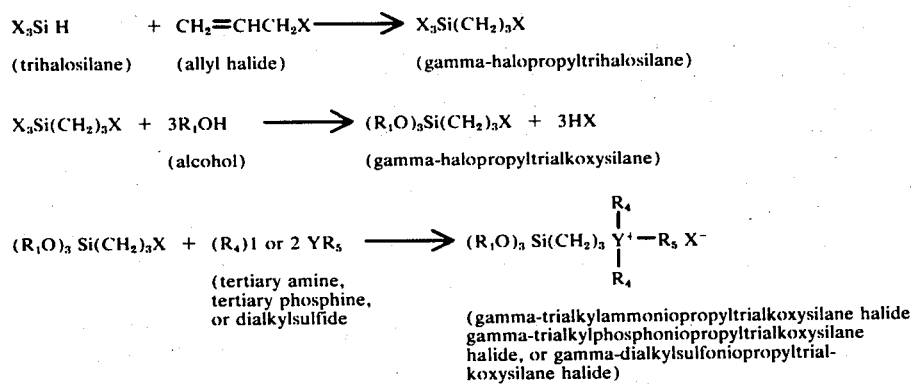

The trihalosilane (where the halogen is chlorine or bromine) is reacted with the allyl chloride at about 100° C. for from 4 to 10 hours in the presence of a catalyst, e.g., chloroplatinic acid or platinum. The resultant gammahalopropyltrihalosilane is reacted with a lower alcohol to produce the gamma-halopropyltrialkoxysilane. At least three equivalents of alcohol per equivalent of halopropyltrihalosilane are added slowly to the silane. The gamma-halopropyltrihalosilane may be dissolved in an inert solvent, preferably hexane or pentane. (See W. Noll, "Chemistry and Technology of Silanes", Academic Press, New York, 1968, page 81 for the alcoholysis of halosilanes.) One equivalent of the gamma-halopropyltrialkoxysilane is reacted with one equivalent of the tertiary amine, tertiary phosphine, or dialkylsulfide to produce the organosilane. An inert solvent, preferably of high dielectric constant, may be used. The reaction is carried out at temperatures of from 40° to 120° C. and a time of 2 to 10 hours for the reaction of the bromopropyltrialkoxysilane and 120° to 150° C. for 2 to 20 hours for the reaction of the chloropropyltrialkoxysilane.

The compounds of Formula I when at least one $R_4$ is a carboxy-substituted $C_{1-4}$ alkyl group are prepared in the same manner except for the last reaction step. Here, a tertiary amine, tertiary phosphine or dialkylsulfide having a carboxy-containing alkyl group(s) is reacted with the alpha, beta or gamma-haloalkyltrialkoxysilane at 50° to 200° C. for 2 hours to 20 hours. Such carboxy-substituted tertiary amines, tertiary phosphines, and dialkylsulfides are produced by reacting $$R_4YHR_5 \text{ or } HYR_5$$

(where Y is sulfur)

with $X(CH_2)_{1-4}COOH$ in the presence of base at elevated temperatures, e.g. 50° to 150° C.

The compounds of Formula I when at least one $R_4$ is $(C_xH_{2x}O)_mZ$ with $x$, $m$ and Z as defined above are produced in the manner given above except for the last reaction step. Thus, alphabeta- and gamma-haloalkyltrialkoxysilane is reacted with a tertiary amine, tertiary phosphine, or dialkylsulfide where at least one substituent is $(C_xH_{2x}O)_mZ$ The reaction takes place at a temperature of 50° to 200° C. and a time of from 2 to 10 hours.

Compounds of Formula I when one $R_4$ is oxygen are prepared by following the reactions outlined above up to the last reaction step. At this point, a dialkyl amine, dialkyl phosphine or alkylthiol is reacted with the halosilane at 50° to 200° C. for from 4 to 10 hours and then with base to produce an intermediate tertiary amine, phosphine, or dialkyl sulfide. These intermediates are then reacted with $H_2O_2$ at 20° to 100° C. or preferably $O_3$ in an inert solvent at −80° to 20° C. to yield the organosilane.

When $b$ is 2 in Formula I, a trihalovinylsilane of formula $X_3SiCH{=}CH_2$ (which is commercially available) is reacted with hydrogen bromide in the presence of peroxide or light to produce a beta-haloethyltrihalosilane. This compound is reacted with an alcohol and thereafter with an appropriate amine, phosphine, or sulfide in the manner discussed above for the preparation of the compounds of Formula I when $b$ is 3.

When $b$ is 1 in Formula I, the starting reactant is a commercially available trihalomethylsilane of formula $X_3SiCH_3$.

This silane is reacted with chlorine or, preferably a half mole of bromine and a half mole of chlorine in the presence of light (such as provided by an ordinary tungsten or fluorescent lamp). The resultant alphahalomethyltrihalosilane is reacted with an alcohol and thereafter an appropriate amine, phosphine or sulfide in the manner discussed above with the compounds of Formula I when $b$ is 3.

Examples of compunds illustrative of compounds of Formula I follow:

$(CH_3O)_3SiCH_2N^+(CH_3)_2C_{12}H_{25}$ $Cl^-$ $(C_2H_5O)_3SiCH_2N^+(CH_3)_2C_6H_5$ $Cl^-$ $(C_2H_5O)_3Si(CH_2)_3N^+(C_2H_5)_2C_{10}H_{21}$ $Br^-$ $(C_3H_7O)_3SiCH_2N^+(C_3H_7)_2C_6H_4CH_3$ $Br^-$ $(C_4H_9O)_3Si(CH_2)_2N^+(C_2H_5)(CH_2C_6H_5)_2$ $Cl^-$ $(CH_3O)_3SiCH_2P^+(C_2H_5)_2C_{12}H_{25}$ $Cl^-$ $(C_2H_5O)_3Si(CH_2)_3P^+(C_4H_9)_2C_6H_5$ $Cl^-$ $(C_3H_7O)_3Si(CH_2)_2S^+(CH_3)C_6H_5$ $Cl^-$ $(CH_3O)_3SiCH_2CH_2S^+(C_2H_5)C_8H_{17}$ $Br^-$ $(CH_3O)_3SiCH_2N^+(C_2H_4COOH)_2C_{10}H_{21}$ $Br^-$ $(C_2H_5O)_3Si(CH_2)_3N^+(CH_2COOH)(CH_3)C_{12}H_{25}$ $Cl^-$ $(C_2H_5O)_3Si(CH_2)_2P^+(C_3H_6COOH)(C_2H_5)C_{10}H_{21}$ $Cl^-$ $(C_4H_9O)_3SiCH_2S^+(C_3H_6COOH)C_6H_{13}$ $Br^-$ $(CH_3O)_3SiCH_2N^+(C_2H_4OH)_2C_8H_{17}$ $Cl^-$ $(C_4H_9O)_3Si(CH_2)_3P^+(C_4H_8OH)_2C_6H_4CH_3$ $Cl^-$ $(C_2H_5O)_3SiCH_2S^+(C_3H_6OH)C_{10}H_{21}$ $Cl^-$ $(CH_3O)_3SiCH_2N^+(O)^-(CH_3)C_{12}H_{25}$ $(C_2H_5O)_3Si(CH_2)_3P^+(O)^-(C_2H_5)C_{12}H_{25}$ $(C_2H_5O)_3Si(CH_2)_2S^+(O)^-C_{10}H_{21}$ $(CH_3O)_3SiCH_2N^+[(C_2H_4O)_3H](CH_3)C_8H_{17}$ $Cl^-$ $(CH_3O)_3Si(CH_2)_2N^+[(C_4H_8O)_{15}CH_3](CH_3)C_6H_{13}$ $(C_2H_5O)_3Si(CH_2)_3N^+[(C_2H_4O)_6H]_2C_{10}H_{21}$ $Cl^-$ $(CH_3O)_3SiCH_2N^+[(C_2H_4O)_3COCH_3]_2C_8H_{17}$ $Cl^-$ $(C_3H_7O)_3SiCH_2P^+[(C_3H_6O)_{12}H]_2CH_2C_6H_5$ $Cl^-$ $(C_4H_9O)_3Si(CH_2)_3P^+[(C_2H_4O)_4C_3H_7](CH_3)_2$ $Br^-$ $(CH_3O)_3Si(CH_2)_2P^+[(C_2H_4O)_5COC_2H_5]_2C_4H_9$ $Br^-$ $(CH_3O)_3SiCH_2S^+[(C_2H_4O)_5H]C_{10}H_{21}$ $Cl^-$ $(C_2H_5O)_3Si(CH_2)_2S^+[(C_3H_6O)_8C_3H_7]CH_3$ $Br^-$ $(CH_3O)_3Si(CH_2)_3S^+[(C_2H_4O)_{12}COC_4H_9]CH_3$ $Cl^-$

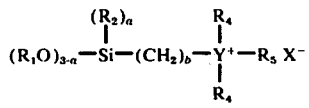

II where $R_1$ is a $C_{1-14}$ alkyl group, $R_2$ is a $C_{1-12}$ alkyl group $a$ is 1 or 2, $b$ is 1–3, $R_4$ is a $C_{1-12}$ alkyl, aryl or arylalkyl group, a carboxy-substituted $C_{1-4}$ alkyl group, $(C_xH_{2x}O)_mZ$ where $x$ is 2–4, $m$ is 1–20, and Z is hydrogen, a $C_{1-3}$ alkyl group or a $C_{1-4}$ acyl group, or oxygen provided only one $R_4$ is oxygen, $R_5$ is a $C_{1-12}$ alkyl, aryl or arylalkyl group, X is halide, Y is N, S or P, and the sum of the carbon atoms in $R_2$, $R_5$ and $R_4$ when $R_4$ is alkyl, aryl, arylalkyl or carboxy-substituted alkyl, does not exceed 20.

The compounds of Formula II are prepared in a manner similar to the preparation of the compounds of Formula I except for the fact that the starting reactants (when $b$ is 1, 2, or 3) all have a $c_{1-12}$ alkyl group or two $C_{1-12}$ alkyl groups attached to the Si atom in place of a halogen atom(s). The starting reactant is commercially available when $R_2$ is $CH_3$. When $R_2$ is $C_2H_5$ or greater, the compound is prepared by reacting a silane with an appropriate olefin. Thus, $X_{3-a}SiH_{1+a}$ is reacted with a $C_2$ to $C_{12}$ olefin to obtain the desired starting reactant. The remaining reaction steps and conditions for producing the desired organosilane of Formula II are essentially the same as for producing the compounds of Formula I.

Examples of compounds of Formula II are:

$(CH_3O)_2CH_3SiCH_2N^+(CH_3)_2C_{12}H_{25}$ $Cl^-$ $(C_2H_5O)_2C_6H_{13}Si(CH_2)_2N^+(CH_3)_2C_4H_9$ $Cl^-$ $(C_3H_7O)(C_3H_7)_2Si(CH_2)_3N^+(C_2H_5)_2C_8H_{17}$ $Cl^-$ $(CH_3O)(CH_3)_2SiCH_2P^+(CH_3)_2C_{10}H_{21}$ $Cl^-$ $(C_3H_7O)_2C_2H_5Si(CH_2)_2S^+(C_4H_9)C_6H_{12}C_6H_5$ $Cl^-$ $(CH_3O)_2C_8H_{17}Si(CH_2)_3N^+(C_2H_4COOH)(CH_3)C_4H_9$ $Cl^-$ $(C_2H_5O)(CH_3)_2Si(CH_2)_2P^+(CH_2COOH)_2C_{10}H_{21}$ $Cl^-$ $(C_3H_7O)_2CH_3SiCH_2S^+(C_3H_9COOH)C_6H_{13}$ $Cl^-$ $(CH_3O)_2CH_3SiCH_2N^+(C_2H_4OH)_2C_{12}H_{25}$ $Cl^-$ $(C_3H_7O)(CH_3)_2SiCH_2P^+(C_3H_6OH)(C_4H_9)_2$ $Br^-$ $(C_4H_9O)_2CH_3Si(CH_2)_3S^+(C_3H_6OH)CH_3$ $Br^-$ $(CH_3O)_2CH_3SiCH_2N^+(O)^-(CH_3)C_{10}H_{21}$ $(CH_3O)_2C_{10}H_{21}Si(CH_2)_2P^+(O)^-(C_4H_9)_2$ $(C_4H_9O)(CH_3)_2Si(CH_2)_3S^+(O)^-C_8H_{17}$ $(CH_3O)_2CH_3SiCH_2N^+[(C_3H_6O)_{20}H]_2C_6H_5$ $Cl^-$ $(CH_3O)_2C_2H_5Si(CH_2)_2N^+[(C_4H_8O)_6C_2H_5]_2CH_3$ $Cl^-$ $(C_2H_5O)(CH_3)_2SiCH_2P^+[(C_2H_4O)_2H](C_6H_5)_2$ $Cl^-$ $(C_2H_5O)_2C_8H_{17}Si(CH_2)_3P^+[(C_2H_4O)_4C_3H_7]_2C_4H_9$ $Cl^+$ $(CH_3O)_2CH_3SiCH_2P^+[(C_2H_4O)_6COCH_3]_2C_8H_{17}$ $Cl^-$ $(CH_3O)_2CH_3SiCH_2S^+[(C_3H_6O)_2H]C_6H_{13}$ $Cl^-$ $(C_2H_5O)(C_2H_5)_2Si(CH_2)_3S^+[(C_2H_4O)_5CH_3]C_8H_{17}$ $Br^-$ $(C_2H_5O)_2C_{10}H_{21}SiCH_2N^+[(C_2H_4O)_2COC_2H_5](C_4H_9)_2$ $Cl^-$ $(CH_3O)_2C_4H_9Si(CH_2)_2S^+[(C_2H_4O)_2COCH_3]C_{12}H_{25}$ $Br^-$

Compounds of Formulas I and II when $R_4$ is an alkyl, aryl, arylalkyl group or oxygen and disclosed in British Patents Nos. 686,068 and 882,053 and U.S. Pats. Nos. 2,955,127, 3,557,178, 3,730,701 and 3,817,739. Compounds of Formulas I and II when $R_4$ is a carboxy-substituted alkyl group or $(C_xH_{2x}O)_mZ$ are disclosed in commonly assigned copending patent application "Organosilane Compounds" by Heckert and Watt, U.S. Ser. No. 570,532, filed Apr. 22, 1975. (The disclosure of this application is herein incorporated by reference.)

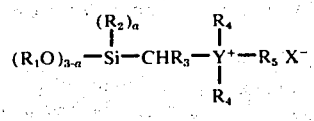

III wherein $R_1$ is a $C_{1-4}$ alkyl group, $a$ is 0 to 2, $R_2$ is a $C_{1-12}$ alkyl group, $R_3$ is a $C_{1-12}$ alkyl group, $R_4$ is a $C_{1-12}$ alkyl, aryl or arylalkyl group, a carboxy-substituted $C_{1-4}$ alkyl group, $$(C_xH_{2x}O)_mZ$$

where $x$ is 2–4, $m$ is 1–20, and Z is hydrogen, a $C_{1-3}$ alkyl group or a $C_{1-4}$ acyl group, or oxygen provided only one $R_4$ is oxygen, $R_5$ is a $C_{1-12}$ alkyl, aryl or arylalkyl group, X is halide, Y is N, S or P and the sum of the carbon atoms in $R_2$, $R_3$, $R_5$ and $R_4$ when $R_4$ is alkyl, aryl, arylalkyl or carboxy-substituted alkyl does not exceed 20.

The compounds of Formula III when $a$ is 0 and $R_4$ is an alkyl group are prepared by the following route:

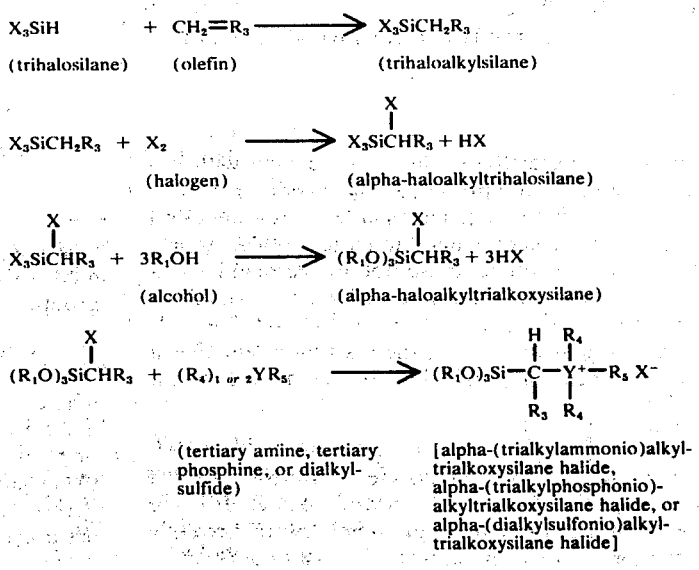

The trihalosilane is reacted with an olefin at 100° C. for 4 to 10 hours under a pressure of 50 to 300 psi. in the presence of a chloroplatinic acid or platinum catalyst to produce the trihaloalkylsilane. This reaction is reported by F. P. Mackay, O. W. Steward and P. G. Campbell in "Journal of the American Chemical Society", 79, 2764 (1957) and J. L. Speier, J. A. Webster and S. W. Barnes in Journal of the American Chemical Society, 79, 974 (1957). The trihaloalkylsilane is then halogenated in a known manner by treating it with halogen in the presence of light (such as that provided by ordinary tungsten of fluorescent lamps). Preferably, halogenation is carried out to only partial completion and a distillation is performed to recycle unreacted alkylsilane. The remaining reactions are the same as those described above in connection with the preparation of the compounds of Formula I.

When $a$ is 1 or 2, the preparation of the compounds is essentially the same except for the use of an alkyl substituted silane as the starting reactant.

When $R_4$ is a carboxy-substituted $C_{1-4}$ alkyl group, oxygen or $$(C_xH_{2x}O)_mZ$$

where $x$ is 2–4, $m$ is 1–20, and Z is hydrogen, a $C_{1-3}$ alkyl group, or a $C_{1-4}$ acyl group, an appropriate amine, phosphine, or sulfide is used in the reaction step as discussed above for the preparation of similarly substituted compounds of Formula I.

The compounds that follow are illustrative of compounds of Formula III.

$(C_2H_5O)_3SiCH(C_8H_{17})N^+(CH_3)_2C_8H_{17}$ $Cl^-$ $(CH_3O)_3SiCH(C_{10}H_{21})N^+(C_2H_4COOH)_2CH_3$ $Cl^-$ $(C_3H_7O)_2CH_3SiCH(C_{12}H_{25})N^+(C_2H_4OH)(CH_3)_2$ $Cl^-$ $(C_4H_9O)_3SiCH(C_3H_7)N^+[(C_2H_4O)_{10}H]_2C_6H_{13}$ $Br^-$ $(CH_3O)_3SiCH(C_{10}H_{21})N^+[(C_2H_4O)_2C_3H_7](CH_3)C_6H_5$ $Br^-$ $(CH_3O)_3SiCH(CH_3)N^+[(C_2H_4O)_3COC_2H_5](C_2H_5)_2$ $Br^-$ $(C_2H_5O)_2CH_3SiCH(C_8H_{17})N^+(O)^-(CH_3)_2$ $(CH_3O)_3SiCH(C_8H_{17})P^+(CH_3)_3$ $Cl^-$ $(CH_3O)_2CH_3SiCH(CH_3)P^+(C_3H_6COOH)_2C_2H_4C_6H_5$ $Cl^-$ $(C_2H_5O)_3SiCH(C_{10}H_{21})P^+(C_2H_4OH)C_4H_9$ $Cl^-$ $(CH_3O)_3SiCH(C_3H_7)P^+(O)^-(CH_3)C_{12}H_{25}$ $(CH_3O)_3SiCH(C_8H_{17})P^+[(C_2H_4O)_6H]_2CH_3$ $Cl^-$ $(C_2H_5O)_3SiCH(C_6H_{13})P^+[C_3H_6O)_2C_2H_5](CH_3)_2$ $Cl^-$ $(CH_3O)_3SiCH(CH_3)S^+(CH_3)C_{10}H_{21}$ $Br^-$ $(C_2H_5O)_2CH_3SiCH(C_{12}H_{25})S^+(C_3H_6COOH)CH_3$ $Cl^-$ $(CH_3O)_2C_{12}H_{25}SiCH(C_2H_5)S^+(C_2H_4OH)C_2H_5$ $Cl^-$ $(CH_3O)_3SiCH(C_{10}H_{21})S^+(O)^-C_5H_{11}$ $(C_2H_5O)_3SiCH(C_4H_9)S^+[(C_3H_6O)_{10}H]C_6H_5$ $Cl^-$ $(C_2H_5O)_3SiCH(CH_3)S^+[(C_2H_4O)_{20}C_2H_5]CH_3$ $Br^-$

Commonly assigned copending patent application "Organosilane Compounds" by Heckert and Watt, U.S. Ser. No. 570,537, filed Apr. 22, 1975 discloses the preparation of these compounds. (The disclosure of this application is herein incorporated by reference).

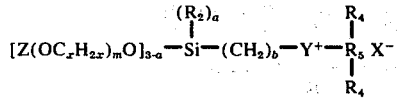

wherein Z is hydrogen, a $C_{1-3}$ alkyl group or a $C_{1-4}$ acyl group, $x$ is 2–4, $m$ is 1–20, $a$ is 0–2, $R_2$ is a $C_{1-12}$ alkyl group, $b$ is 1–3, $R_4$ is a $C_{1-12}$ alkyl, aryl or arylalkyl group, a carboxy-substituted $C_{1-4}$ alkyl group $$(C_xH_{2x}O)_mZ$$

where $x$, $m$ and Z are as defined above, or oxygen provided only one $R_4$ is oxygen, $R_5$ is a $C_{1-12}$ alkyl, aryl or arylalkyl group, X is halide, Y is N, S or P and the sum of the carbon atoms in $R_2$, $R_5$ and $R_4$ when $R_4$ is alkyl, aryl, arylalkyl or carboxy-substituted alkyl does not exceed 20.

The compounds with Formula IV are prepared in substantially the same manner as those of Formula II with the exception that the $R_1OH$ used in the alcoholysis step is $$Z(OC_xH_{2x})_mOH$$

or alternatively the compounds of Formula II are heated in the presence of $$Z(OC_xH_{2x})_mOH$$

under conditions such that $R_1OH$ is removed from the system.

Exemplary compounds of Formula IV are as follows:

$[CH_3(OC_2H_4)O]_3SiCH_2N^+(CH_3)_2C_{12}H_{25}$ $Cl^-$ $[CH_3(OC_2H_4)_5O]_2CH_3Si(CH_2)_3N^+(CH_2COOH)_2C_{10}H_{21}$ $Cl^-$ $[H(OC_3H_6)_3O]_3SiCH_2N^+(C_2H_4OH)(CH_3)(C_{12}H_{25})$ $Cl^-$ $[H(OC_2H_4)_{18}O]_3Si(CH_2)_2N^+(O)^-(CH_3)C_{10}H_{21}$ $[CH_3CO(OC_2H_4)_{10}O]_3SiCH_2N^+[(C_2H_4O)_{14}H]_2C_6H_{12}C_6H_5$ $Cl^-$ $[C_3H_7(OC_2H_4)_8O]_2C_6H_{13}SiCH_2N^+[(C_3H_6O)CH_3](CH_3)_2$ $Br^-$ $[H(OC_4H_8)_8O]_3SiCH_2N^+[(C_2H_4O)_4COCH_3]_2CH_3$ $Cl^-$ $[C_2H_5(OC_2H_4)_2O]_3Si(CH_2)_2P^+(CH_3)_2C_{10}H_{21}$ $Br^-$ $[CH_3(OC_3H_6)_{14}O]_3SiCH_2P^+(C_2H_4COOH)(C_6H_{13})_2$ $Cl^-$ $[C_2H_5(OC_2H_4)O]_2CH_3Si(CH_2)_2P^+(C_4H_8OH)(CH_3)C_6H_5$ $Cl^-$ $[CH_3(OC_2H_4)_8O]_3SiCH_2P^+(O)^-(CH_3)C_8H_{17}$ $[C_2H_5OC(OC_2H_4)_2O]_3Si(CH_2)_3P^+[(C_2H_4O)_8H]_2C_6H_{13}$ $Cl^-$ $[CH_3(OC_4H_8)O]_3SiCH_2P^+[(C_3H_6O)_2C_3H_7](C_4H_9)_2$ $Br^-$ $[C_2H_5OC(OC_2H_4)O]_3SiCH_2S^+(CH_3)C_8H_{17}$ $Cl^-$ $[H(OC_2H_4)_4O]_3Si(CH_2)_2S^+(C_2H_4COOH)C_{12}H_{25}$ $Br^-$ $[CH_3(OC_2H_4)_{20}O]_3Si(CH_2)_3S^+(C_3H_6OH)C_{12}H_{25}$ $Br^-$ $[H(OC_3H_6)_{12}O]_3Si(CH_2)_2S^+(O)^-C_5H_{11}$ $[C_2H_5(OC_2H_4)_4O]_3SiCH_2S^+[(C_2H_4O)_{20}H]CH_3$ $Br^-$ $[H(OC_2H_4)_{12}O]_3Si(CH_2)_3S^+[(C_2H_4O)C_3H_7]C_6H_4CH_3$ $Cl^-$

Commonly assigned copending patent application "Organosilane Compounds" by Heckert and Watt U.S. Ser. No. 570,539, filed Apr. 22, 1975 discloses the preparation of these compounds. (The disclosure of this application is herein incorporated by reference.)

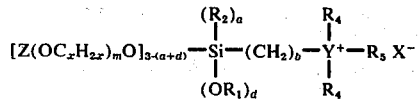

V.

wherein Z is hydrogen, a $C_{1-3}$ alkyl group or a $C_{1-4}$ acyl group, $x$ is 2–4, $m$ is 1–20, $R_2$ is a $C_{1-12}$ alkyl group, $R_1$ is a $C_{1-4}$ alkyl group, $a$ is 0 or 1, $d$ is 1 or 2 provided $a+d$ does not exceed 2, $b$ is 1–3, $R_4$ is a $C_{1-12}$ alkyl, aryl or arylalkyl group, a carboxy-substituted $C_{1-4}$ alkyl group, $$(C_xH_{2x}O)_mZ$$

where $x$, $m$ and Z are defined above, or oxygen provided only one $R_4$ is oxygen, $R_5$ is a $C_{1-12}$ alkyl, aryl or aryl alkyl group, X is halide, Y is N, S or P and the sum of the carbon atoms in $R_2$, $R_5$ and $R_4$ when $R_4$ is alkyl, aryl, arylalkyl or carboxy-substituted alkyl does not exceed 20.

The compounds of Formula V are formed in substantially the same manner as those of Formula II except that a mixture of $R_1OH$ and $$Z(OC_xH_{2x})_mOH$$

in the desired ratio is used in place of $R_1OH$ or, alternatively, the compounds of Formula II are heated with less than $3-a$ equivalents of $$Z(OC_xH_{2x})_mOH$$

under conditions such that $R_1OH$ is removed from the system.

Examples of illustrative compounds follow:

$[H(OC_2H_4)_5O](CH_3)(C_2H_5O)SiCH_2N^+(CH_3)_2C_{12}H_{25}$ $Cl^-$ $[C_3H_7(OC_2H_4)_3O](CH_3O)_2Si(CH_2)_3N^+(C_2H_5)_2C_6H_5$ $Cl^-$ $[H(OC_4H_8)_6O](C_2H_5)_2Si(CH_2)_3N^+[(C_2H_4O)_{10}H]_2C_{12}H_{25}$ $Br^-$ $[CH_3CO(OC_2H_4)_3O]_2(C_2H_5O)Si(CH_2)_2N^+](C_2H_4O)C_2H_5]_2(C_6H_5CH_3)$ $Cl^-$ $[H(OC_2H_4)_{12}O](C_4H_8O)_2SiCH_2N^+[(C_2H_4O)_4COCH_3]_2C_{10}H_{21}$ $Cl^-$ $[C_2H_5(OC_2H_4)_3O](C_2H_5)(CH_3O)SiCH_2N^+(O)^-(CH_3)C_6H_{13}$ $[H(OC_3H_6)_{12}O](C_2H_5O)_2SiCH_2N^+(C_2H_5COOH)(CH_3)C_{10}H_{21}$ $Cl^-$ $[C_2H_5(OC_2H_4)_{14}O]_2(C_4H_9O)Si(CH_2)_3N^+(C_4H_8OH)(CH_3)C_7H_{15}$ $Cl^-$ $[H(OC_2H_4)_{16}O]_2(CH_3O)SiCH_2P^+(CH_3)_2C_6H_4C_2H_5$ $Cl^-$ $[C_3H_7(OC_2H_4)_6O](C_2H_5)(CH_3O)SiCH_2P^+[(C_2H_4O)_8H]_2C_8H_{17}$ $Br^-$ $[CH_3OC(OC_2H_4)_2O]_2(CH_3O)Si(CH_2)_2P^+[(C_3H_6O)_3C_2H_5](C_4H_9)_2$ $Cl^-$ $[H(OC_4H_8)_2O](C_{12}H_{25})(CH_3O)SiCH_2P^+(O)^-(CH_3)C_6H_5$ $[C_2H_5(OC_2H_4)_6O](CH_3O)_2SiCH_2P^+(C_3H_6COOH)_2CH_3$ $Cl^-$ $[H(OC_2H_4)_8O]_2(C_4H_9O)SiCH_2P^+(C_3H_6OH)_2C_2H_5$ $Br^-$ $[H(OC_2H_4)_{10}O]_2(C_3H_7O)SiCH_2S^+(CH_3)C_6H_{12}C_6H_5$ $Cl^-$ $[H(OC_4H_8)_2O]_2(CH_3O)Si(CH_2)_3S^+[(C_2H_4O)_4H]CH_3$ $Br^-$ $[C_3H_7(OC_2H_4)_6O](CH_3)(CH_3O)SiCH_2S^+[(C_3H_6O)_8CH_3]C_3H_7$ $Cl^-$ $[CH_3CO(OC_2H_4)_3O](C_2H_5O)_2Si(CH_2)_2S^+(C_2H_4OH)C_{12}H_{25}$ $Cl^-$ $[CH_3(OC_3H_6)_{12}O](CH_3O)_2SiCH_2S^+(C_3H_6COOH)CH_2C_6H_5$ $Br^-$ $[H(C_2H_4O)_6O](C_{12}H_{25})(CH_3O)SiCH_2S^+(O)^-C_6H_{13}$

Commonly assigned copending patent application "Organosilane Compounds" by Heckert and Watt U.S. Ser. No. 570,539, filed Apr. 22, 1975 discloses the preparation of these compounds. (The disclosure of this application is herein incorporated by reference.)

$$[Z(OC_xH_{2x})_mO]_{3-a}-\overset{(R_2)_a}{\overset{|}{Si}}-CHR_3-\overset{R_4}{\overset{|}{\underset{R_4}{\underset{|}{Y^+}}}}-R_5\ X^- \qquad \text{VI.}$$

wherein Z is hydrogen, a $C_{1-3}$ alkyl group or a $C_{1-4}$ acyl group, $x$ is 2–4, $m$ is 1–20, $a$ is 0–2, $R_2$ is a $C_{1-12}$ alkyl group, $R_3$ is a $C_{1-12}$ alkyl group, $R_4$ is a $C_{1-12}$ alkyl, aryl or arylalkyl group, a carboxy-substituted $C_{1-4}$ alkyl group, $$(C_xH_{2x}O)_mZ$$

where $x$ is 2–4, $m$ is 1–20, and Z is hydrogen, a $C_{1-3}$ alkyl group or a $C_{1-4}$ acyl group, or oxygen provided only one $R_4$ is oxygen, $R_5$ is a $C_{1-12}$ alkyl, aryl or arylalkyl group, X is halide, Y is N, S or P and the sum of the carbon atoms in $R_2$, $R_3$, $R_5$ and $R_4$ when $R_4$ is alkyl, aryl, arylalkyl or carboxy-substituted alkyl does not exceed 20.

The compounds of Formula VI are formed in the same manner as those of Formula III with the exception that $$Z(OC_xH_{2x})_mOH$$

is used in place of $$R_1OH$$

during the alcoholysis of the halo-silane. Alternatively, preparation may be effected by the heating of compounds of Formula III with $$Z(OC_xH_{2x})_mOH$$

under conditions such that all of the $$R_1OH$$

is removed from the system.

The following compounds illustrate the compounds of Formula VI.

$[CH_3(OC_2H_4)_3O]_3SiCH(CH_3)N^+(CH_3)_2C_8H_{17}$ $Cl^-$ $[C_2H_5(OC_2H_4)O]_2CH_3SiCH(C_2H_5)N^+(C_2H_5)N^-(C_2H_4OH)_2C_{12}H_{25}$ $Cl^-$ $[H(OC_4H_8)_8O]_3SiCH(C_4H_9)N^+(C_2H_4COOH)(C_4H_9)CH_2C_6H_5$ $Cl^-$ $[CH_3CO(OC_2H_4)_2O]_3SiCH(C_2H_5)N^-(O)^-(CH_3)C_{10}H_{21}$ $[H(OC_3H_6)_6O]_3SiCH(C_{12}H_{25})N^+[(C_2H_4O)_{10}H]_2CH_3$ $Br^-$ $[C_3H_7(OC_2H_4)O]_3SiCH(C_3H_7)N^+[(C_4H_8O)_3C_3H_7](C_2H_5)_2$ $Cl^-$ $[C_2H_5(OC_2H_4)_4O]_3SiCH(C_2H_5)N^+[(C_2H_4O)_6COCH_3]_2CH_3$ $Cl^-$ $[H(OC_2H_4)_{16}O]_3SiCH(C_4H_9)P^+(C_2H_5)_2C_6H_4C_4H_9$ $Cl^-$ $[CH_3(OC_2H_4)_{16}O]_2C_4H_9SiCH(CH_3)P^+(C_3H_6COOH)_2C_5H_{11}$ $Cl^-$ $[C_2H_5OC(OC_2H_4)_5O]_3SiCH(CH_3)P^+(C_2H_4OH)(CH_3)C_{12}H_{25}$ $Cl^-$ $[H(OC_2H_4)_2O]_3SiCH(C_{10}H_{25})P^+(O)^-(CH_3)C_6H_{13}$ $[H(OC_2H_4)_2O]_3SiCH(C_8H_{17})P^+[(C_2H_4O)_6H]_2C_4H_9$ $Br^-$ $[CH_3(OC_4H_8)_2O]_3SiCH(CH_3)P^+[(C_2H_4O)C_2H_5](CH_3)_2$ $Cl^-$ $[C_2H_5(OC_2H_4)_2O]_3SiCH(C_6H_{13})S^+(CH_3)C_{10}H_{21}$ $Cl^-$ $[H(OC_2H_4)_{14}O]_2CH_3SiCH(C_8H_{17})S^+(C_2H_4COOH)C_6H_{13}$ $Cl^-$ $[H(OC_3H_6)_4O]_3SiCH(C_{12}H_{25})S^+(C_4H_8OH)C_6H_5$ $Cl^-$ $[CH_3CO(OC_2H_4)_3O]_3SiCH(C_2H_5)S^+(O)^-C_{12}H_{25}$ $[C_3H_7(OC_2H_4)O]SiCH(C_3H_7)S^+[(C_3H_6O)H]C_6H_{13}$ $Cl^-$ $[H(OC_4H_8)_4O]_2CH_3SiCH(C_4H_9)S^+]C_2H_4O)_8C_3H_7]CH_3$ $Br^-$

Commonly assigned copending patent application "Organosilanee Compounds" by Heckert and Watt U.S. Ser. No. 570,539, filed Apr. 22, 1975 discloses the preparation of these compounds. (The disclosure of this application is herein incorporated by reference.)

VII.

$$[Z(OC_xH_{2x})_mO]_{3-(a+d)}-\underset{(OR_1)_d}{\overset{(R_2)_a}{Si}}-CHR_3-\overset{R_4}{\underset{R_4}{Y^+}}-R_5\ X^-$$

wherein Z is hydrogen, a $C_{1-3}$ alkyl group or a $C_{1-4}$ acyl group, $X$ is 2–4, $m$ is 1–20, $R_2$ is a $C_{1-12}$ alkyl group, $R_1$ is a $C_{1-4}$ alkyl group, $a$ is 0 or 1, $d$ is 1 or 2 provided $a+d$ does not exceed 2, $R_3$ is a $C_{1-12}$ alkyl group, $R_4$ is a $C_{1-12}$ alkyl, aryl or arylalkyl group, a carboxy-substituted $C_{1-4}$ alkyl group, $(C_xH_{2x}O)_m$ Z where $x$, $m$ and Z are as defined above, or oxygen provided only one $R_4$ is oxygen, $R_5$ is a $C_{1-12}$ alkyl, aryl or arylalkyl group, X is halide, Y is N, S or P and the sum of the carbon atoms in $R_2$, $R_3$, $R_5$ and $R_4$ when $R_4$ is alkyl, aryl, arylalkyl or carboxy-substituted alkyl does not exceed 20.

Compounds having Formula VII are prepared in substantially the same manner as those of Formula III except that a mixture of $R_1OH$ and $Z(OC_xH_{2x})_mOH$ in the desired ratio is used in place of $R_1OH$. Alternatively, the compounds of Formula III are heated together with less than 3-$a$ equivalents of $Z(OC_xH_{2x})_mOH$ under conditions such that $R_1OH$ is removed from the system.

The following compounds are illustrative of the compounds of Formula VII:

$[H(OC_2H_6)_6O](C_2H_5O)_2SiCHC_{12}H_{25}N^+[(C_2H_4O)_{10}H]_2C_6H_{13}$ $Br^-$ $[CH_3CO(OC_2H_4)_3O]_2(C_2H_5O)SiCHCH_3N^+[(C_2H_4O)C_2H_5]_2C_6H_5CH_3$ $Cl^-$ $[H(OC_2H_4)_{12}O](C_4H_8O)_2SiCHC_2H_5N^+[(C_2H_4O)_4COCH_3]_2C_{10}H_{21}$ $Cl^-$ $[C_3H_7(OC_2H_4)_3O](C_2H_5)(CH_3O)SiCHCH_3N^+(O)^-(CH_3)C_6H_{13}$ $[C_2H_5(OC_2H_4)_{14}O]_2(C_4H_9O)SiCHC_6H_{13}N^+(C_6H_{12}OH)(CH_3)C_5H_{11}$ $Cl^-$ $[H(OC_2H_4)_{16}O]_2(CH_3O)SiCHC_4H_9P^+(CH_3)_2C_{12}H_{25}$ $Cl^-$ $[CH_3CO(OC_2H_4)_2O]_2(CH_3O)SiCHC_{10}H_2]P^+[(C_3H_7O)_3C_2H_5](C_4H_9)_2$ $Cl^-$ $[C_2H_5(OC_2H_4)_6O](CH_3O)_2SiCHCH_3P^+(C_3H_6COOH)_2CH_3$ $Cl^-$ $[H(OC_2H_4)_{10}O]_2(C_3H_7O)SiCHC_5HH_{11}S^+(CH_3)C_{12}H_{25}$ $Cl^-$ $[H(OC_4H_8)_2O]_2(CH_3O)SiCHC_8H_{17}S^+CH_3C_6H_5$ $Br^-$

Commonly assigned copending patent application "Organosilane Compounds" by Heckert and Watt, U.S. Ser. No. 570,537, filed Apr. 22, 1975 discloses the preparation of the compounds. (The disclosure of this application is herein incorporated by reference.)

VIII.

$$(R_1O)_{3-a}-\overset{(R_2)_a}{Si}-(CH_2)_b-O-CH_2-CHOH-CH_2-\overset{R_4}{\underset{R_4}{Y^+}}-R_5\ X^-$$

wherein $R_1$ is a $C_{1-4}$ alkyl group, $a$ is 0–2, $R_2$ is a $C_{1-12}$ alkyl group, $b$ is 1–3, $R_4$ is a $C_{1-12}$ alkyl, aryl or arylalkyl group, a carboxy-substituted $C_{1-4}$ alkyl group, $(C_xH_{2x}O)_mZ$ where $x$ is 2–4, $m$ is 1–20, and Z is hydrogen, a $C_{1-3}$ alkyl group or a $C_{1-4}$ acyl group, or oxygen provided only one $R_4$ is oxygen, $R_5$ is a $C_{1-12}$ alkyl, aryl or arylalkyl group, X is halide, Y is N, S or P and the sum of the carbon atoms in $R_2$, $R_5$ and $R_4$ when $R_4$ is alkyl, aryl, arylalkyl or carboxy-substituted alkyl does not exceed 20.

The compounds of Formula VIII are prepared by initially reacting (when $a$ is 0 and $b$ is 3) trihalosilane with an alcohol ($R_1OH$) at 0° to 50° C. for 1 to 10 hours to produce a trialkoxysilane. This silane is then reacted with an allylglycidylether $$(CH_2{=}CHCH_2OCH_2\overset{O}{\overset{/\backslash}{CHCH_2}})$$

in the presence of 0.01 to 0.1% chloroplatinic acid or platinum at 100° C. for 2 to 10 hours. The resultant product $$[(R_1O)_3Si-(CH_2)_3OCH_2\overset{O}{\overset{/\backslash}{CHCH_2}}]$$

is reacted with a tertiary amine, tertiary phosphine, or dialkylsulfide in the presence of an acid in an inert solvent at 60° to 100° C. for 1 to 10 hours to produce the ccompound of Formula X. $R_4$ is an alkyl group, carboxy-substituted alkyl group, oxygen or a $(C_xH_{2x}O)_mZ$ group as defined above.

When *a* is 1 or 2, the preparation of the compounds is essentially the ame except for the use of an alkyl substituted silane as the starting reactant.

When *b* is 2 in Formula VIII, a trihalovinylsilane of formula $X_3SiCH{=}CH_2$ (which is commercially available) is reacted with hydrogen bromide in the presence of peroxide or light to produce a beta-haloethyltrihalosilane. This compound is reacted with an alcohol, an allylglycidylether, and finally with an appropriate amine, phosphine, or sulfide in the manner discussed above for the preparation of the compounds of Formula VIII when *b* is 3.

When *b* is 1 in Formula VIII, the starting reactant is a commercially available trihalometylsilane of formula $X_3SiCH_3$ This silane is reacted with chlorine or, preferably a half mole of bromine and a half mole of chlorine in the presence of light (such as provided by an ordinary tungsten or fluorescent lamp). The resultant alpha-halomethyltrihalosilane is reacted with an alcohol, an allylglycidylether, and finally an appropriate amine, phosphine or sulfide in the manner discussed above with the compounds of Formula VIII when *b* is 3.

The following compounds illustrate the compounds of Formula VIII.

$(CH_3O)_3Si(CH_2)_3OCH_2CHOHCH_2N^+(CH_3)_2C_{18}H_{25}$ $Cl^-$ $(CH_3O)_2C_2H_5SiCH_2OCH_2CHOHCH_2N^+(C_3H_6COOH)(C_4H_9)C_8H_{17}$ $Cl^-$ $(C_2H_5O)_3Si(CH_2)_2OCH_2CHOHCH_2N^+(C_2H_4OH)_2C_6H_5$ $Br^-$ $(CH_3O)_3Si(CH_2)_3OCH_2CHOHCH_2N^+(O)(CH_3)C_8H_{17}$ $(CH_3O)_3SiCH_2OCH_2CHOHCH_2N^+[(C_2H_4O)H]_2C_{10}H_{21}$ $Br^-$ $(CH_3O)_2C_2H_5SiCH_2OCH_2CHOHCH_2N^+[(C_3H_6O)_{12}C_2H_5](CH_3)_2$ $Cl^-$ $(C_4H_9O)_3SiCH_2OCH_2CHOHCH_2N^+[(C_2H_4O)_3COCH_3]_2CH_3$ $Br^-$ $(CH_3O)_3SiCH_2OCH_2CHOHCH_2P^+(C_4H_9)_2CH_2C_6H_5$ $Br^-$ $(C_4H_9O)_3SiCH_2OCH_2CHOHCH_2P^+(C_2H_4COOH)_2C_{8H7}$ $Cl^-$ $(CH_3O)_3Si(CH_2)_2OCH_2CHOHCH_2P^+(C_2H_4OH)(C_2H_5)C_{10}H_{21}$ $Cl^-$ $(CH_3O)_3SiCH_2OCH_2CHOHCH_2P^+(O)^-(CH_3)C_{10}H_{21}$ $(CH_3O)_3SiCH_2OCH_2CHOHCH_2P^+[C_3H_6O)_{18}H]_2CH_3$ $Br^-$ $(C_2H_5O)$ $(CH_3)_2SiCH_2OCH_2CHOHCH_2P^+[(C_2H_4O)CH_3]_2C_6H_{13}$ $(CH_3O)_3SiCH_2OCH_2CHOHCH_2S^+(CH_3)C_6H_4CH_3$ $Cl^-$ $(CH_3O)_2C_7H_{15}SiCH_2OCH_2CHOHCH_2S^+(C_2H_4COOH)C_8H_{17}$ $Cl^-$ $(CH_3O)_3Si(CH_2)_2OCH_2CHOHCH_2S^+(C_2H_4OH)C_6H_{13}$ $Cl^-$ $(C_2H_5O)_3SiCH_2OCH_2CHOHCH_2S^+(O)^-C_{10}H_{21}$ $(CH_3O)_3SiCH_2OCH_2CHOHCH_2S^+[(C_2H_4O)_{12}H]CH_3$ $Br^-$ $(C_2H_5O)_3SiCH_2OCH_2CHOHCH_2S^+[(C_2H_4O)_2C_3H_7]C_2H_5$ $Br^-$

Commonly assigned copending patent application "Organosilane Compounds" by Heckert and Watt, U.S.. Ser. No. 570,537, filed Apr. 22, 1975 discloses the preparation of these compounds. (The disclosure of this application is herein incorporated by reference.)

$$[Z(OC_xH_{2x})_mO]_{3-a}-\overset{(R_2)_a}{\overset{|}{Si}}-(CH_2)_b-O-CH_2-CHOH-CH_2-\overset{R_4}{\overset{|}{\underset{R_4}{\underset{|}{Y^+}}}}-R_5\ X^- \qquad \text{IX.}$$

wherein Z is hydrogen, a $C_{1-3}$ alkyl group or a $C_{1-4}$ acyl group, *x* is 2–4, *m* is 1–20, *a* is 0–2, $R_2$ is a $C_{1-12}$ alkyl group, *b* is 1–3, $R_4$ is a $C_{1-12}$ alkyl, aryl or arylalkyl group, a carboxy-substituted $C_{1-4}$ alkyl group $(C_xH_{2x}O)_m\ Z$ where *x* is 2–4, *m* is 1–20, and Z is hydrogen, a $C_{1-3}$ alkyl group or a $C_{1-4}$ acyl group, or oxygen provided only one $R_4$ is oxygen, $R_5$ ia a $C_{1-12}$ alkyl, aryl or arylalkyl group, X is a halide, Y is N, S or P and the sum of the carbon atoms in $R_2$, $R_5$, and $R_4$ and $R_4$ is alkyl, aryl, arylalkyl or carboxy-substituted alkyl does not exceed 20.

compounds of Formula IX are prepared in a manner identical with that of Formula VIII except that $R_1OH$ is replaced by $HO(C_xH_{2x}O)_mZ$.

The following compounds are exemplary of Formula IX compounds.

$[H(OC_2H_4)_{20}O]_3SiCH_2OCH_2CHOHCH_2N^+(CH_3)_2C_{10}H_{21}$ $Cl^-$ $[CH_3(OC_3H_6)_{10}O]_2CH_3SiCH_2OCH_2CHOHCH_2N^+(C_2H_4COOH)(C_4H_9)_2$ $Cl^-$ $[C_2H_5(OC_2H_4)_2O]_3Si(CH_2)_3OCH_2CHOHCH_2N^+(C_2H_4OH)_2(C_8H_{17})$ $Cl^-$ $[C_3H_7(OC_2H_4)O]_3SiCH_2OCH_2CHOHCH_2N^+(O)^-(C_4H_9)C_6H_5$ $[CH_3CO(OC_2H_4)_6O]_3Si(CH_2)_2OCH_2CHOHCH_2N^+[(C_2H_4O)_{10}H]_2CH_3$ $Cl^-$ $[H(OC_3H_6)_6O]_2C_{12}H_{25}SiCH_2OCH_2CHOHCH_2N^+[(C_2H_4O)_6C_3H_7](CH_3)_2$ $Br^-$ $[C_2H_5(OC_2H_4)_4O]_2SiCH_2SiCH_2OCH_2CHOHCH_2N^+[(C_2H_4O)_2COCH_3]_2CH_3$ $Br^-$ $[C_2H_5(OC_2H_4)_5O]_3SiCH_2OCH_2CHOHCH_2P^+(C_2H_5)_2C_8H_{17}$ $Cl^-$ $[H(OC_3H_6)_6]_3Si(CH_2)_2OCH_2CHOHCH_2P^+(C_3H_6COOH)_2C_6H_{13}$ $Cl^-$ $[C_2H_5(OC_2H_4)_2O]_2CH_3SiCH_2OCH_2.$
$CHOHCH_2P^+(C_2H_4OH)(CH_3)C_8H_{17}$ $Cl^-$ $[CH_3(OC_3H_6)O]_3Si(CH_2)_3OCH_2CHOHCH_2P^+(O)^-(CH_3)C_{10}H_{21}$ $[C_2H_5(OH_4C_2)_{12}O]_3Si(CH_2)_2OCH_2.$
$CHOHCH_2P^+[(C_2H_4O)_2H]_2C_6H_4CH_3$ $Br^-$ $[CH_3CO(OC_2H_4)_8O]_3SiCH_2OCH_2.$
$CHOHCH_2P^+[(C_3H_6O)_8C_2H_5](C_4H_9)_2$ $Cl^-$ $[H(OC_2H)_4O]_3SiCH_2OCH_2.$
$CHOHCH_2S^+(CH_3)C_{11}H_{23}$ $Cl^-$ $[C_2H_5(OC_2H_4)_6O]_2C_4H_9SiCH_2OCH_2.$
$CHOHCH_2S^+(C_3H_6COOH)C_{10}H_{21}$ $Cl^-$ $[CH_3(OC_4H_8)_4O]_3SiCH_2OCH_2CHOHCH_2S^+(C_4H_8OH)C_8H_{17}$ $Br^-$ $[H(OC_2H_4)_{14}O]_3Si(CH)_2OCH_2CHOHCH_2S^+(O)^-C_6H_{12}C_6H_5$ $[C_3H_7(OC_2H_4)O]_3SiCH_2OCH_2CHOHCH_2S^+[(C_2H_4O)_6H]C_6H_{13}$ $Cl^-$ $[C_2H_5CO(OC_2H_4)_2O]_3SiCH_2OCH_2.$
$CHOHCH_2S^+[(C_4H_8O)_{12}CH_3]C_8H_{17}$ $Cl^-$

Commonly assigned copending patent application "Organosilane Compounds" by Heckert and Watt U.S. Ser. No. 570,531, filed Apr. 22, 1975 discloses the preparation of these compounds. (The disclosure of this application is herein incorporated by reference).

$[H(OC_2H_4)_8O](C_2H_5O)_2SiCH_2OCH_2.$
$CHOHCH_2P^+(CH_3)_2C_6H_5$ $Cl^-$ $[CH_3(OC_2H_4)_6O](C_{12}H_{25})(CH_3O)SiCH_2OCH_2.$
$CHOHCH_2P^+[(C_2H_4O)_6OCH_3]_2(CH_3)$ $Cl^-$ $[CH_3CO(OC_3H_6)_4O]_2(CH_3O)Si(CH_2)_3OCH_2.$
$CHOHCH_2p^+(C_4H_8OH)_2CH_3$ $Cl^-$ $[H(OC_4H_8)_2O](CH_3O)(CH_3O)(CH_3)SiCH_2OCH_2.$
$CHOHCH_2S^+[(C_2H_4O)_3H]C_2H_5$ $Cl^-$ $[C_3H_7(OC_2H_4O](C_4H_9O](C_4H_9O)_2Si(CH_2)_2OCH_2.$
$CHOHCH_2S^+(C_3H_6COOH)CH_3$ $Br^-$ $[C_2H_5CO(OC_2H_4)_{10}O]_2(C_2H_5O)SiCH_2OCH_2.$
$CHOHCH_2S^+(O)^-C_{12}H_{25}$

Commonly assigned copending patent application "Organosilane Compounds" by Heckert and Watt U.S. Ser. No. 570,531, filed Apr. 22, 1975 discloses the preparation of these compounds. (The disclosure of this application is herein incorporated by reference.)

Siloxane oligomers of the above organosilanes are also useful in the present invention. Such oligomers are formed from the monomers by the controlled addition of from 1 to 100 equivalents of water, preferably in an inert solvent such as alcohol, tetrahydrofuran, etc. As used herein, "oligomers" is used to mean a degree of polymerization of from 2 to 100, preferably 2 to 20. A higher degree of polymerization adversely affects the ability of the compound to bond itself to the hard surface and is for this reason avoided. Examples of siloxane oligomers having varying degrees of polymerization are readily visualized from the above examples of organosilane monomers.

$$[Z(OC_xH_{2x})_mO]_{3-(a+d)}-\underset{(OR_1)_d}{\overset{(R_2)_a}{Si}}-(CH_2)_b-O-CH_2-CHOH-CH_2-\underset{R_4}{\overset{R_4}{Y^+}}-R_5\ X^- \qquad \text{X.}$$

wherein Z is hydrogen, a $C_{1-3}$ alkyl group or a $C_{1-4}$ acyl group, $x$ is 2–4, $m$ is 1–20, $R_2$ is a $C_{1-12}$ alkyl group, $R_1$ is a $C_{1-4}$ alkyl group, $a$ is 0 or 1, $d$ is 1 or 2 provided $a+d$ does not exceed 2, $b$ is 1–3, $R_4$ is a $C_{1-12}$ alkyl, aryl or arylalkyl group, a carboxy-substituted $C_{1-4}$ alkyl group, $$(C_xH_{2x}O)_mZ$$

where $x$, $m$ and Z are as defined above, or oxygen provided only one $R_4$ is oxygen, $R_5$ is a $C_{1-12}$ alkyl, aryl or arylalkyl group, X is halide, Y is N, S or P and the sum of the carbon atoms in $R_2$, $R_5$ and $R_4$ when $R_4$ is alkyl, aryl, arylalkyl or carboxy-substituted alkyl does not exceed 20.

These compounds are prepared in a manner similar to that described for the compounds of Example IX except that only a part of the $R_1OH$ is replaced by $$HO(C_xH_{2x}O)_mZ.$$

The following compounds are examples of compounds having the formula X.

$[H(OC_2H_4)_{12}O](CH_3O)_2SICH_2OCH_2.$
$CHOHCH_2N^+(CH_3)_2C_{12}H_{25}$ $Cl^-$ $[H(OC_3H_6O)_3O](C_2H_5O)(CH_3)Si(CH_2)_2OCH_2.$
$CHOHCH_2N^+(CH_2COOH)(C_4H_9)_2$ $Cl^-$ $[C_2H_5(OC_2H_4)_8O](C_2H_5O)_2SiCH_2OCH_2.$
$CHOHCH_2N^+(C_6H_8OH)_2CH_3$ $Cl^-$ $[CH_3(OC_4H_8)_3O]_3(C_4H_9O)Si(CH_2)_3OCH_2.$
$CHOHCH_2N^+(O)^-(CH_3)C_{10}H_{21}$ $[CH_3CO(OC_2H_4)_6O]_2(CH_3O)SiCH_2OCH_2.$
$CHOHCH_2N^+[(C_2H_4O)_8H]_2CH_3$ $Br^-$ $[H(OC_2H_4)_{16}O](C_2H_5O)(C_{16}H_{21})SiCH_2OCH_2.$
$CHOHCH_2N^+[(C_2H_4O)C_3H_7](CH_3)_2$ $Cl^-$

When metallic or vitreous surfaces are contacted with a detergent composition containing the above-described organosilanes, a thin coating of the organosilane is attached to the surfaces. It is theorized that the positively charged organosilane is attracted to negatively charged metallic or vitreous surface. The silicon atom in the organosilane forms a bond with the surface. The presence of the positive charge on the organosilane is necessary to allow the bonding to take place within a reasonable time when the organosilane is applied from a dilute system such as is normally encoun- Water-soluble organic anionic detergents are used. U.S. Pat. No. 3,579,454 issued May 18, 1971 to Everett J. Collier, Col. 11, line 49 to Col. 12, line 15 (the disclosure of which is herein incorporated by reference) describes suitable detergents which fall within the above-described class. The ratio of organosilane to anionic detergent is from 1:1 to 1:10,000, preferably 1:1 to 1:500, most preferably 1:3 to 1:60. An amount of organosilane below 1:10000 does not initially provide a noticeable soil release benefit. A benefit is realized from compositions containing a ratio of organosilane to detergent of less than 1:10000 after repeated washings due to a gradual buildup of deposited organosilane, but is, for all practical purposes, too gradual to be of significance. The upper level of organosilane in the composition is dictated by cost and the fact that no noticeable additional soil release benefit is obtained. Generally, the amount of organosilane in a detergent composition does not exceed 10%.

tered in detergent composition uses. The terminal alkyl groups attached to the positively charged compound provide the soil release benefits. It is believed that the organosilane compound polymerizes on the surface to form a thin coating of the polymer. The coating is responsible for imparting the soil release benefits to the surface. That is a hard surface having on it the polymeric coating will be soiled; however, the soil is not tenaciously bound to the surface by virtue of the coating and for this reason is easily washed away.

Repeated washing will subsequently remove the polymeric coating. However, the soil release benefit is renewed by using the detergent compositions of this invention. The ability to provide a soil release benefit from a wash or rinse solution is especially beneficial in that it allows the consumer to efficiently and economically impart the benefit to a hard surface without adversely affecting its appearance.

Detergent compositions in which the organosilane compound is included are described in the following paragraphs.

Light Duty Liquid Detergent Composition

Detergent compositions intended for use in the hand washing of cooking utensils and table ware are generally formulated in a liquid form. The composition consists essentially of from 0.01 to 10%, preferably 0.1 to 2% of the organosilane; from 10 to 90%, preferably 20 to 40% of an anionic detergent as above described, and the balance water. An electrolyte such as potassium or sodium chloride is optionally included at a level of from 0.5 to 5%, preferably 1 to 2%. A hydrotrope, e.g. toluene sulfonate, cumene sulfonate, or xylene sulfonate is optionally included in the composition at a level of from 1 to 20%, preferably 2 to 5%. An alcohol, e.g. a $C_{1-4}$ alcohol, may be a part of the composition at a level of from 1 to 2%, preferably 3 to 10%.

Window Cleaner

Window cleaner compositions contain from 0.001 to 5%, preferably 0.002 to 1% of the organosilane. The remainder of the window cleaner composition consists essentially of from 0.1 to 5%, preferably 0.5 to 3% of a water-soluble anionic detergent and the balance organic inert solvent or solvent/water mixture. Suitable organic inert solvents include the following: methanol, ethanol, isopropanol, acetone, and methyl ethyl ketone.

Car Wash Detergent Composition

A detergent composition intended for use in an automatic car wash consists essentially of from 0.01 to 10%, preferably 0.1 to 2% of the organosilane; from 20 to 35%, preferably 23 to 28% of the anionic detergent; and the balance water. Optionally from 1 to 10%, preferably 1 to 3% of magnesium sulfate is included in the composition.

In Tank Toilet Bowl Cleaner

In tank toilet bowl cleaners consist essentially of from 0.01 to 10%, preferably 0.5 to 2% of the organosilane; from 0.5 to 20%, preferably 1 to 15% of the anionic detergent; from 0.1 to 5%, preferably 0.5 to 2% of sodium bisulfate; from 0.1 to 20%, preferably 1 to 15% of a lower alcohol, i.e., a $C_{1-4}$ alcohol; and the balance water.

Abrasive Cleaner

The organosilane of this invention can also be used in a detergent composition intended for the cleaning of hard surfaces such as ovens. Such compositions contain from 0.002 to 5%, preferably 0.01 to 1% of the organosilane; from 0.1 to 10%, preferably 1 to 5% of a water-soluble anionic detergent; and from 50 to 95%, preferably 50 to 75% of a water-insoluble abrasive. Suitable abrasives include the following: quartz, pumice, pumicate, talc, silica sand, calcium carbonate, china clay, zirconium silicate, bentonite, diatomaceous earth, whiting, feldspar and aluminum oxide.

Nonionic, zwitterionic, and ampholytic detergents may be included in the above-described compositions at low levels, e.g. not greater than 50% based on the total detergent level. Such minor additions do not materially affect the performance of the present compositions.

The following examples are illustrative of this invention.

EXAMPLE I

The organosilanes of this invention are tested for their ability to provide a soil release benefit to hard surfaces in the manner described immediately below.

A solution of 0.003% organosilane and 0.06% sodium dodecyl sulfate in distilled water is prepared. The solution has a temperature of 55° C. A clean glass slide is dipped into the solution and held there for 10 minutes. The solution is continuously mixed while the glass slide is being treated. After the 10 minute hold time, the glass slide is removed and rinsed with tap water having a temperature of about 15° C. The rinsed slide is dried at 72° C. for 20 minutes.

Next the slide is soiled by dipping it into an oatmeal slurry for 15 seconds and baking it for 20 minutes at 72° C. Thereafter, the slide is washed with distilled water in a tergotometer for 3 minutes at 55° C. The resultant slide is dyed with a solution of iodide and potassium iodide in water to facilitate its grading.

The slide is graded visually and assigned a number ranging from 0 (equal to an untreated glass slide, i.e., the control) to 4 (a totally clean slide). Intermediate grades of 1 (slightly better than control), 2 (a definite noticeable improvement) and 3 (slide is almost clean) are used.

Each organosilane is tested 5 times in the manner above described and its average is recorded. The individual organosilanes and their grades are reported below.

| | Grade |
|---|---|
| $(C_2H_5O)_3SiCH_2N^+(O)^-(CH_3)C_{12}H_{25}$ | 4 |
| $(C_2H_5O)_3SiCH_2S^+(O)^-C_{12}H_{25}$ | 4 |
| $(CH_3O)_3Si(CH_2)_3N^+(CH_3)_2C_6H_4C_2H_7Cl^-$ | 3 |
| $(CH_3O)_3SiCH_2N^+(C_2H_4OH)(CH_3)C_{12}H_{25}Cl^+$ | 4 |
| $(CH_3O)_3Si(CH_2)_3OCH_2CHOHCH_2N^+(CH_3)_2C_8H_{17}Cl^-$ | 1.5 |
| $(C_2H_5O)_2C_4H_9SiCH_2N^+(CH_3)_2C_{12}H_{25}Cl^-$ | 4 |

-continued

| | Grade |
|---|---|
| $[H(OC_2H_4)_{18}O]]_3SiCH_2N^+(C_2H_5)_2C_{10}H_{21}Cl^-$ | 4 |
| $[CH_3(OC_2H_4)_{12}O]_2CH_3SiCH_2N^+(CH_3)_2C_{12}H_{25}Br^-$ | 4 |
| $[CH_3CO(OC_2H_4)_4]_3Si(CH_2)_3N^+(CH_3)_2C_{10}H_{21}Cl^-$ | 4 |
| $[H(OC_2H_4)_8](CH_3O)_2SiCH_2N^+(CH_3)_2C_{12}H_{25}Cl^-$ | 4 |
| $[CH_3(OC_2H_4)_6O]_3SiCH(C_{12}H_{25})N^+(CH_3)_3Br^-$ | 4 |
| $[H(OC_2H_4)_2O]_2(CH_3O)SiCH(C_8H_{17})N^+(CH_3)_2C_6H_{13}Cl^-$ | 4 |
| $[H(OC_2H_4)_4O]_3SiCH_2OCH_2CHOHCH_2N^+(CH_3)_2C_{12}H_{25}Cl^-$ | 3 |
| $[CH_3(OC_2H_4)_8O]_2(CH_3O)SiCH_2OCH_2CHOHCH_2N^+(C_4H_9)_3Cl^-2$ | |
| $(C_2H_5O)_3SiCH_2N^+(CH_3)_2C_{12}H_{25}Cl^-$ | 4 |
| $(C_2H_5O)_3SiCH_2P^+(CH_3)_2C_{12}H_{25}Cl^-$ | 4 |
| $(C_2H_5O)_3Si(CH_2)_2N^+(CH_3)_2C_{12}H_{25}Cl^-$ | 4 |
| $(C_2H_5O)_3Si(CH_2)_3N^+(CH_3)_2C_{12}H_{25}Br^-$ | 4 |
| $(C_2H_5O)_3SiCH_2N^+(CH_3)_2C_6H_{13}Cl^-$ | 1 |
| $(CH_3O)_3SiCH_2N^+(CH_3)_2C_6H_5Cl^-$ | 1 |
| $(C_2H_5O)_3SiCH_2N^+(CH_3)_2C_8H_{17}Cl^-$ | 4 |
| $(C_2H_5O)_3SiCH_2S^+(CH_3)C_{10}H_{21}Cl^-$ | 4 |
| $(C_4H_8O)_3SiCH_2N^+(CH_3)_2C_2H_4C_6H_5Cl^-$ | 4 |
| $(CH_3O)_3SiCH_2N^+[(C_3H_6O)_3C_2H_5]_2C_8H_{17}Cl^-$ | 1 |
| $(C_2H_5O)_3Si(CH_2)_3N^+(C_2H_5)[(C_4H_9O)_8H]C_4H_9Cl^-$ | 1.5 |
| $(C_2H_5O)_3SiCH_2N^+(C_3H_7\ COOH)_2C_8H_{17}Cl^-$ | 1 |
| $(C_2H_5O)_3SiCH_2N^+[(C_2H_4O)_4COCH_3]_2C_8H_{17}Cl^-$ | 2.5 |
| $(C_2H_5O)_3SiCH(C_{12}H_{25})N^+(C_2H_5)_3Cl^-$ | 4 |
| $(C_2H_5O)_3SiCH(C_{12}H_{25}P^+(C_2H_5)_3Cl^-$ | 4 |
| $(CH_3O)_2CH_3SiCH(C_8H_{17})N^+(CH_3)_3Br^-$ | 4 |
| $(CH_3O)_2CH_3SiCH(C_{10}H_{21})S^+(CH_3)_2Br^-$ | 4 |
| Siloxane dimer of $(C_2H_5O)_3SiCH_2N^+(CH_3)_2C_{12}H_{25}Cl^-$ | 4 |
| Siloxane dimer of $(C_2H_5O)_2(CH_3)SiCH_2N^+(CH_3)_2C_8H_{17}Cl^-$ | 3 |
| Siloxane trimer of $(CH_3O)_3Si(CH_2)_3P^+(CH_3)_2C_{12}H_{25}Cl^-$ | 4 |
| Siloxane dimer of $(CH_3O)_3SiCH_2S^+(CH_3)C_{12}H_{25}Cl^-$ | 4 |

Different anionic detergents mixed with the above organosilanes in an organosilane to anionic detergent ratio of 1:1 to 1:10,000 give substantially the same grades. An absence of any turbidity after 20 days at 20° C. indicates that the the components are compatible.

The following are examples of detergent compositions which contain the organosilane of this invention and which impart a noticeable soil release benefit to metallic and vitreous surfaces contacted therewith.

EXAMPLE II

EXAMPLE II

| Light Duty Liquid Detergent Composition | |
|---|---|
| Sodium salt of sulfated coconut alcohol | 23.0% |
| $(C_2H_5O)_3SiCH_2N^+(CH_3)_2C_8H_{17}Cl^-$ | 1.0% |
| Water | 76.0% |

When $(C_2H_5O)_3SiCH_2P^+(CH_3)_2C_8H_{17}Cl^-$ or $(C_2H_5O)_3SiCH_2S^+(CH_3)C_8H_{17}Cl^-$ is substituted for the organosilane of Example II, substantially the same results are obtained.

EXAMPLE III

EXAMPLE III

| Light Duty Liquid Detergent Composition | |
|---|---|
| Sodium salt of sulfated coconut alcohol ethoxylated with 3 moles of ethylene oxide | 22.8% |
| Sodium salt of sulfated coconut alcohol | 4.5% |
| $(CH_3O)_2C_{10}H_{21}Si(CH_2)_3N^+(CH_3)_3Cl^-$ | 0.05% |
| Potassium chloride | 2.0% |
| Dimethyldodecylamine oxide | 5.0% |
| Ethanol | 6.0% |
| Water | balance |

EXAMPLE IV

EXAMPLE IV

| Abrasive Cleaner | |
|---|---|
| Sodium linear $C_{12}$ alkyl benzene sulfonate | 5.0% |
| $(CH_3O)_2C_2H_5Si(CH_2)_3N^+(C_2H_5)_2C_8H_{17}Cl^-$ | 0.5% |
| Silica | 90.0% |
| Misc. (water, perfume, dye, etc.) | balance |

Substantially the same results are obtained when $(CH_3O)_2C_2H_5Si(CH_2)_3P^+(C_2H_5)_2C_8H_{17}Cl^-$ or $(CH_3O)_2C_2H_5Si(CH_2)_3S^+(C_2H_5)C_8H_{17}Cl^-$ is substituted for the organosilane of Example IV.

EXAMPLE V

EXAMPLE V

| Car Wash Detergent Composition | |
|---|---|
| Sodium salt of sulfated coconut alcohol ethoxylated with 3 moles of ethylene oxide | 26.0% |
| $(CH_3O)_3Si(CH_2)_3N^+(CH_3)_2\ CH_2C_6H_5Cl^-$ | 1.5% |
| Magnesium sulfate | 1.5% |
| Water | balance |

The use of $(CH_3O)_3Si(CH_2)_3P^+(CH_3)_2CH_2C_6H_5Cl^-$ or $(CH_3O)_3Si(CH_2)_3S^+(CH_3)CH_2C_6H_5Cl^-$ in this example gives substantially the same results.

EXAMPLE IV

EXAMPLE VI

| Window Cleaner | |
|---|---|
| Sodium $C_{14}$ alkyl sulfate | 3.0% |
| $(C_2H_5O)_3Si(CH_2)_3N^+(CH_3)_2C_8H_{17}Br^-$ | .05% |
| Isopropanol | 96.95% |

When $(C_2H_5O)_3Si(CH_2)_3P^+(CH_3)_2C_8\ H_{17}Br^-$ or $(C_2H_5O)_3Si(CH_2)_3S^+(CH_3)C_8H_{17}Br^-$ is substituted for the organosilane of Example VI substantially the same results are obtained.

Replacement of the organosilanes of Examples II–VI with the organosilanes of Example I gives satisfactory products in that a noticeable soil release benefit is obtained.

The composition of this invention are generally diluted with water during usage. Under normal usage conditions, from 0.2 to 20 ppm of organosilane is found in the wash or rinse solution. Surprisingly, even from such a low concentration the organosilane molecule of this invention deposits itself upon hard surfaces in an amount sufficient to provide a noticeable soil release benefit. As previously discussed, it is believed the positively charged atom in the molecule is largely responsible for the necessary deposition taking place under dilute conditions.

What is claimed is:

1. A detergent composition capable of imparting soil release benefits to metallic and vitreous surfaces contacted therewith consisting essentially of:

a. an organosilane having the formula

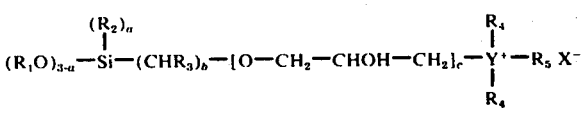

or is a siloxane oligomer thereof wherein $R_1$ is an alkyl group containing 1 to 4 carbon atoms, or $$Z(OCH_xH_{2x})_m$$

where $x$ is 2 to 4, $m$ is 1 to 20, and Z is hydrogen, an alkyl group containing 1 to 3 carbons or an acyl group containing 1 to 4 carbon atoms; $R_2$ is an alkyl group containing 1 to 12 carbon atoms, $a$ is 0 to 2; $R_3$ is hydrogen or an alkyl group containing 1 to 12 carbon atoms, $b$ is 1 to 3; $c$ is 0 or 1; $R_4$ is an alkyl, aryl or arylalkyl group containing 1 to 12 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen and further provided that there is no $X^-$ when $R_4$ is oxygen; $R_5$ is an alkyl, aryl or arylalkyl group containing 1 to 12 carbon atoms; X is halide; and Y is nitrogen, sulfur or phosphorus and the sum of the carbon atoms in $R_2$, $R_3$, $R_5$ and $R_4$ when $R_4$ is alkyl, aryl, arylalkyl or carboxy-substituted alkyl does not exceed 20 carbon atoms; and b. a water-soluble organic anionic detergent in a weight ratio or organosilane to detergent of from 1:1 to 1:10,000.

2. The composition of claim 1 wherein the organosilane has the formula

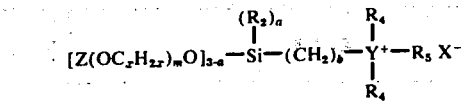

or is a siloxane oligomer thereof wherein Z is hydrogen, an alkyl group containing 1 to 3 carbon atoms or an acyl group containing 1 to 4 carbon atoms, $x$ is 2 to 4, and $m$ is 1 to 20; $R_2$ is an alkyl group containing 1 to 12 carbon atoms; $a$ is 0 to 2; $b$ is 1 to 3; $R_4$ is an alkyl, aryl or arylalkyl group containing 1 to 12 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen and further provided than when $R_4$ is oxygen there is no $X^-$; $R_5$ is an alkyl, aryl or arylalkyl group containing 1 to 12 carbon atoms; X is halide; and Y is nitrogen, sulfur or phosphorus and the sum of the carbon atoms in $R_2$, $R_5$ and $R_4$ when $R_4$ is alkyl, aryl, arylalkyl or carboxy-substituted alkyl does not exceed 20.

3. The composition of claim 1 wherein the organosilane has the formula

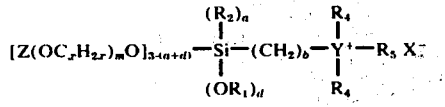

or is a siloxane oligomer thereof wherein Z is hydrogen, an alkyl group containing 1 to 3 carbon atoms or an acyl group containing 1 to 4 carbon atoms, $x$ is 2 to 4, and $m$ is 1 to 20; $R_2$ is an alkyl group containing 1 to 12 carbon atoms; $R_1$ is an alkyl group containing 1 to 4 carbon atoms, $a$ is 0 to 1; $d$ is 1 or 2 provided $a+d$ does not exceed 2; $b$ is 1 to 3; $R_4$ is an alkyl, aryl or arylalkyl group containing 1 to 12 atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen and further provided that when $R_4$ is oxygen there is no $X^-$; $R_5$ is an alkyl, aryl or arylalkyl group containing 1 to 12 carbon atoms; X is halide; and Y is nitrogen, sulfur or phosphorus and the sum of the carbon atoms in $R_2$, $R_5$ and $R_4$ when $R_4$ is alkyl, aryl, arylalkyl or carboxy-substituted alkyl does not exceed 20.

4. The composition of claim 1 wherein the organosilane has the formula

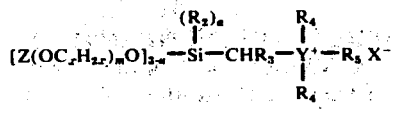

or is a siloxane oligomer thereof wherein Z is hydrogen, an alkyl group containing 1 to 3 carbon atoms or an acyl group containing 1 to 4 carbon atoms, $x$ is 2 to 4, and $m$ is 1 to 20; $R_2$ is an alkyl group containing 1 to 18 carbon atoms; $a$ is 0 to 2; $R_3$ is an alkyl group containing 1 to 12 carbon atoms; $R_4$ is an alkyl, aryl or arylalkyl group containing 1 to 12 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen and further provided that when $R_4$ is oxygen there is no $X^-$; $R_5$ is an alkyl, aryl or arylalkyl group containing 1 to 12 carbon atoms; X is halide; and Y is nitrogen, sulfur or phosphorus and the sum of the carbon atoms in $R_2$, $R_3$, $R_5$ and $R_4$ when $R_4$ is alkyl, aryl, arylalkyl or carboxy-substituted alkyl does not exceed 20.

5. The composition of claim 1 wherein the organosilane has the formula

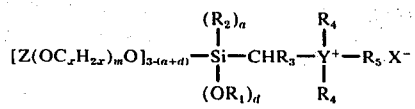

or is a siloxane oilgomer thereof wherein Z is hydrogen, an alkyl group containing 1 to 3 carbon atoms or an acyl group containing 1 to 4 carbon atoms, $x$ is 2 to 4, and $m$ is 1 to 20; $R_2$ is an alkyl group containing 1 to 3 carbon atoms; $R_1$ is an alky group containing 1 to 4 carbon atoms; $a$ is 0 or 1; $d$ is 1 or 2 provided $a+d$ does not exceed 2; $R_3$ is an alkyl group containing 1 to 12 carbon atoms; $R_4$ is an alkyl, aryl or arylalkyl group containing 1 to 12 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen and further provided that when $R_4$ is oxygen there is no $X^-$; $R_5$ is an alkyl, aryl or arylalkyl group containing 1 to 12 carbon atoms; X is halide; and Y is nitrogen, sulfur or phosphorus and the sum of the carbon atoms in $R_2$, $R_3$, $R_5$ and $R_4$ when $R_4$ is alkyl, aryl, arylalkyl or carboxy-substituted alkyl does not exceed 20.

6. The composition of claim 1 wherein the organosilane has the formula

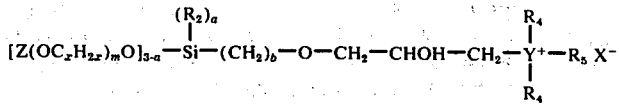

or is a siloxane oligomer thereof wherein Z is hydrogen, an alkyl group containing 1 to 3 carbon atoms or an acyl group containing 1 to 4 carbon atoms, $x$ is 2 to 4, and $m$ is 1 to 20; $R_2$ is an alkyl group containing 1 to 12 carbon atoms; $a$ is 0 to 2; $b$ is 1 to 3; $R_4$ is an alkyl, aryl or arylalkyl group containing 1 to 12 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen and further provided that when $R_4$ is oxygen there is no $X^-$; $R_5$ is an alkyl, aryl or arylalkyl group containing 1 to 12 carbon atoms; X is halide; and Y is nitrogen, sulfur or phosphorus and the sum of the carbon atoms in $R_2$, $R_5$ and $R_4$ when $R_4$ is alkyl, aryl, arylalkyl, or carboxy-substituted alkyl does not exceed 20.

7. The composition of claim 1 wherein the organosilane has the formula

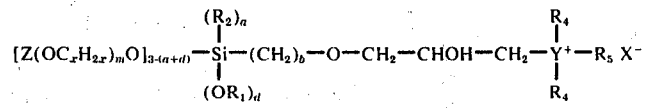

or is a siloxane oligomer thereof wherein Z is hydrogen, an alkyl group containing 1 to 3 carbon atoms or an acyl group containing 1 to 4 carbon atoms, $x$ is 2 to 4, and $m$ is 1 to 20; $R_2$ is an alkyl group containing 1 to 12 carbon atoms; $R_1$ is an alkyl group containing 1 to 4 carbon atoms; $a$ is 0 or 1; $d$ is 1 or 2 provided $a+d$ does not exceed 2; $b$ is 1 to 3; $R_4$ is an alkyl, aryl or arylalkyl group containing 1 to 12 carbon atoms, a carboxy-substituted alky group containing 1 to 4 carbon atoms, $$(C_xH_{2x}O)_mZ$$

where $x$, $m$ and Z are as defined above, or oxygen provided only one $R_4$ is oxygen and further provided that when $R_4$ is oxygen there is no $X^-$; $R_5$ is an alkyl, aryl or arylalkyl group containing 1 to 12 carbon atoms; X is halide; and Y is nitrogen, sulfur or phosphorus and the sum of the carbon atoms in $R_2$, $R_5$ and $R_4$ when $R_4$ is alkyl, aryl, arylalkyl or carboxy-substituted alkyl does not exceed 20.

8. The composition of claim 1 in which said organosilane has the formula

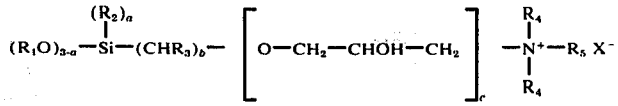

or is a siloxane oligomer thereof wherein $R_1$ is an alkyl group containing 1 to 4 carbon atoms, or $$Z(OC_xH_{2x})_m$$

where $x$ is 2 to 4, $m$ is 1 to 20, and Z is hydrogen, an alkyl group containing 1 to 3 carbons or an acyl group containing 1 to 4 carbon atoms; $R_2$ is an alkyl group containing 1 to 12 carbon atoms; $a$ is 0 to 2; $R_3$ is hydrogen or an alkyl group containing 1 to 12 carbons atoms; $b$ is 1 to 3; $c$ is 0 or 1; $R_4$ is an alkyl, aryl or arylalkyl group containing 1 to 12 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen and further provided that when $R_4$ is oxygen there is no $X^-$; $R_5$ is alkyl, aryl or arylalkyl group containing 1 to 12 carbon atoms; and X is halide; and the sum of the carbon atoms in $R_2$, $R_3$, $R_5$ and $R_4$ when $R_4$ is alkly, aryl, arylalkyl or carboxy-substituted alkyl does not exceed 20 carbon atoms.

9. The composition of claim 1 wherein the organosilane has the formula

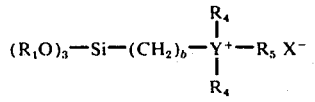

or is a siloxane oligomer thereof wherein $R_1$ is an alkyl group containing 1 to 4 carbon atoms; *b* is 1 to 3; $R_4$ is an alkyl, aryl or arylalkyl group containing 1 to 12 carbon atoms, a carboxy-substituted alkyl group containing 1 to 4 carbon atoms, $(C_xH_{2x}O)_mZ$ where *x* is 2 to 4, *m* is 1 to 20, and Z is hydrogen, an alkyl group containing 1 to 18 carbon atoms or an acyl group containing 1 to 4 carbon atoms, or oxygen provided only one $R_4$ is oxygen and further provided that when $R_4$ is oxygen there is no $X^-$; $R_5$ is an alkyl, aryl or arylalkyl group containing 4 to 12 carbon atoms; X is a halide; and Y is nitrogen, sulfur or phosphorus and the sum of the carbon atoms in $R_5$ and $R_4$, when $R_4$ is alkyl, aryl, aryl alkyl or carboxy-substituted alkyl does not exceed 20.

10. The composition of claim 1 wherein the organosilane has the formula

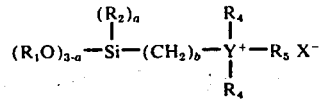

or is a siloxane oligomer thereof wherein $R_1$ is an alkyl group containing 1 to 4 carbon atoms; $R_2$ is an alkyl group containing 1 to 12 carbon atoms; *a* is 1 or 2; *b* is 1 to 3; $R_4$ is an alkyl, aryl or arylalkyl group containing 1 to 12 carbon atoms, a carboxy-substituted alkyl group containing 1 to 4 carbon atoms, $(C_xH_{2x}O)_mZ$ where *x* is 2 to 4, *m* is 1 to 20, and Z is hydrogen, an alkyl group containing 1 to 3 carbon atoms or an acyl group containing 1 to 4 carbon atoms, or oxygen provided only one $R_4$ is oxygen and further provided that when $R_4$ is oxygen there is no $X^-$; $R_5$ is an alkyl, aryl or arylalkyl group containing 1 to 12 carbon atoms; X is a halide; and Y is nitrogen, sulfur or phosphorus and the sum of the carbon atoms in $R_2$, $R_5$ and $R_4$ when $R_4$ is alkyl, aryl, arylalkyl or carboxy-substituted alkyl does not exceed 20.

11. The composition of claim 1 wherein the organosilane has the formula

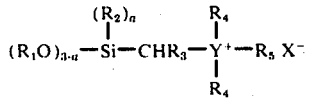

or is a siloxane oligomer thereof wherein $R_1$ is an alkyl group containing 1 to 4 carbon atoms; $R_2$ is an alkyl group containing 1 to 12 carbon atoms; *a* is 0 to 2; $R_3$ is an alkyl group containing 1 to 12 carbon atoms; $R_4$ is an alkyl, aryl or arylalkyl group containing 1 to 12 carbon atoms, a carboxy-substituted alkyl group containing 1 to 4 carbon atoms, $(C_xH_{2x}O)_mZ$ where *x* is 2 to 4, *m* is 1 to 20, and Z is hydrogen, an alkyl group containing 1 to 3 carbon atoms or an acyl group containing 1 to 4 carbon atoms, or oxygen provided only one $R_4$ is oxygen and further provided that when $R_4$ is oxygen there is no $X^-$; $R_5$ is an alkyl, aryl or arylalkyl group containing 1 to 22 carbon atoms; X is a halide; and Y is nitrogen, sulfur or phosphorus and the sum of the carbon atoms in $R_2$, $R_3$, $R_5$ and $R_4$ when $R_4$ is alkyl, aryl, arylalkyl or carboxy-substituted alkyl does not exceed 20.

12. The composition of claim 1 wherein the organosilane has the formula

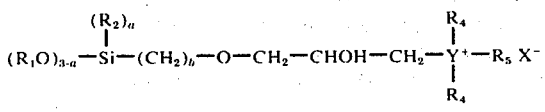

or is a siloxane oligomer thereof wherein $R_1$ is an alkyl group containing 1 to 4 carbon atoms; $R_2$ is an alkyl group containing 1 to 12 carbon atoms; *a* is 0 to 2; *b* is 1 to 3; $R_4$ is an alkyl, aryl or arylalkyl group containing 1 to 12 carbon atoms, a carboxy-substituted alkyl group containing 1 to 4 carbon atoms, $(C_xH_{2x}O)_mZ$ where *x* is 2 to 4, *m* is 1 to 20, and Z is hydrogen, an alkyl group containing 1 to 3 carbon atoms or an acyl group containing 1 to 4 carbon atoms, or oxygen provided only one $R_4$ is oxygen and further provided that when $R_4$ is oxygen there is no $X^-$; $R_5$ is an alkyl, aryl or arylalkyl group containing 1 to 12 carbon atoms; X is a halide; and Y is nitrogen, sulfur or phosphorus and the sum of the carbon atoms in $R_2$, $R_5$ and $R_4$ when $R_4$ is alkyl, aryl, arylalkyl or carboxy-substituted alkyl does not exceed 20.

13. The composition of claim 1 wherein *b* is 1, X is chloride or bromide and the sum of the carbon atoms in $R_2$, $R_3$, $R_5$, and $R_4$ when $R_4$ is alkyl, aryl, arylalkyl or carboxy-substituted alkyl does not exceed 15.

14. The composition of claim 13 wherein the ratio of organosilane to detergent is from 1:1 to 1:500.

15. The composition of claim 1 intended for use as a window cleaner consisting essentially of:

a. from 0.001 to 5% of the organosilane;
b. from 0.1 to 5% of the water-soluble organic anionic detergent; and
c. the balance an inert organic solvent.

16. The composition of claim 1 intended for use as an abrasive cleaner consisting essentially of:

a. from 0.002 to 5% of the organosilane;
b. from 0.1 to 10% of the water-soluble organic anionic detergent; and
c. from 50 to 95% of a water-soluble abrasive.

17. The composition of claim 1 intended for use as a car wash detergent composition consisting essentially of:
a. from 0.01 to 10% of the organosilane;
b. from 20 to 35% of the water-soluble organic anionic detergent; and
d. the balance water.

18. The composition of claim 1 intended for use as in tank toilet bowl cleaner consisting essentially of:
a. from 0.01 to 10% of the organosilane;
b. from 0.5 to 20% of the water-soluble organic anionic detergent;
c. from 0.1 to 5% of sodium bisulfate;
d. from 0.1 to 20% of a lower alcohol; and
d. the balance water.

19. The detergent composition of claim 1 wherein the organosilane has the formula

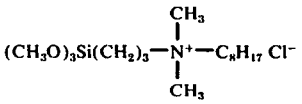

20. The composition of claim 1 intended for use as a light-duty dishwashing composition consisting essentially of:
a. from 0.01 to 10% of the organosilane;
b. from 10 to 90% of the water-soluble organic anionic detergent; and
c. the balance water.

21. The composition of claim 20 consisting essentially of:
a. from 0.1 to 2% of the organosilane
b. from 20 to 40% of the water-soluble organic anionic detergent; and
c. the balance water.

22. The composition of claim 15 consisting essentially of:
a. from 0.002 to 1% of the organosilane;
b. from 0.5 to 3% of the water-soluble organic anionic detergent; and
c. the balance the inert organic solvent.

23. The composition of claim 16 consisting essentially of:
a. from 0.01 to 1% of the oganosilane;
b. from 1 to 5% of the water-soluble organic anionic detergent; and
c. from 50 to 75% of the water-soluble abrasive.

24. The composition of claim 17 additionally containing from 1 to 10% of magnesium sulfate.

25. The composition of claim 21 additionally containing from 0.5 to 5% of an electrolyte.

26. The composition of claim 25 additionally containing from 1 to 20% of a hydrotrope and from 1 to 20% of a lower alcohol.

* * * * *

UNITED STATES PATENT OFFICE
CERTIFICATE OF CORRECTION

PATENT NO. : 4,005,030

DATED : January 25, 1977

INVENTOR(S) : David C. Heckert; David M. Watt, Jr.

It is certified that error appears in the above-identified patent and that said Letters Patent are hereby corrected as shown below:

Column 4, line 8, "$C_{1-14}$" should be -- $C_{1-4}$ --.

Column 4, line 27, "$(R_4)$ 1 or 2 $YR_5$" should be -- $(R_4)_{1 \text{ or } 2}$ $YR_5$ --

Column 5, line 11, "alphabeta" should be -- alpha beta --.

Column 5, line 54, "compunds" should be -- compounds --.

Column 6, line 37, "$C_{1-14}$" should be -- $C_{1-4}$ --.

Column 7, line 52, "$Cl^+$" should be -- $Cl^-$ --.

Column 7, line 63, "and" should be -- are --.

Column 9, line 36, "$(C_2H_5O)_3SiCH(C_6H_{13})P^+[C_3H_6O)_2C_2H_5](CH_3)_2$ should be -- $(C_2H_5O)_3SiCH(C_6H_{13})P^+[(C_3H_6O)_2C_2H_5](CH_3)_2$ --.

Column 11, line 34, "$[CH_3CO(OC_2H_4)_3O](C_2H_5O)Si(CH_2)_2N^+](C_2$" should be -- $[CH_3CO(OC_2H_4)_3O](C_2H_5O)Si(CH_2)_2N^+[(C_2$ --.

Column 11, line 38, "$COCH_3]_2C_{10}H_{21}\ Cl^-$" should be -- $COCH_3]_2C_{10}H_{21}\ Cl^-$ --.

Column 12, line 52, "$[C_2H_5(OC_2H_4)O]_2CH_3SiCH(C_2H_5)N^+(C_2H_5)N^-(C_2$" should be -- $[C_2H_5(OC_2H_4)O]_2CH_3SiCH(C_2H_5)N^+(C_2$ --.

Column 12, line 57, "$)N^-(O)^-(CH_3)C_{10}H_{21}$" should be -- $)N^+(O)^-(CH_3)C_{10}H_{21}$ --.

UNITED STATES PATENT OFFICE

CERTIFICATE OF CORRECTION

PATENT NO. : 4,005,030

DATED : January 25, 1977

INVENTOR(S) : David C. Heckert; David M. Watt, Jr.

It is certified that error appears in the above-identified patent and that said Letters Patent are hereby corrected as shown below:

Column 13, line 16, "$[C_3H_7(OC_2H_4)O]SiCH(C_3H_7)S^+[(C_3H_6O)H]C_6H_{13}$" should be -- $[C_3H_7(OC_2H_4)O]_3SiCH(C_3H_7)S^+[(C_3H_6O)H]C_6H_{13}$ --.

Column 13, line 18, "$[H(OC_4H_8)_4O]_2CH_3SiCH(C_4H_9)S^+]C_2$" should be -- $[H(OC_4H_8)_4O]_2CH_3SiCH(C_4H_9)S^+[C_2$ --.

Column 13, line 23, "570,539" should be -- 570,537 --.

Column 14, line 19, "$SiCHC_5HH_{11}S^+(CH_3)C_{12}H_{25}$ $Cl^-$" should be -- $SiCHC_5H_{11}S^+(CH_3)C_{12}H_{25}$ $Cl^-$ --.

Column 15, line 7, "ame" should be -- same --.

Column 15, line 51, "$(CH_3O)_3Si(CH_2)_3OCH_2CHOHCH_2N^+(O)$" should be -- $(CH_3O)_3Si(CH_2)_3OCH_2CHOHCH_2N^+(O)^-$ --.

Column 15, line 61, "$_4COOH)_2C_{817}$ $Cl^-$" should be -- $_4COOH)_2C_8H_{17}$ $Cl^-$ --.

Column 16, line 17, "570,537" should be -- 570,531 --.

Column 16, line 39, "$R_4$ and $R_4$" should be -- $R_4$ when $R_4$ --.

Column 17, line 67, "$CHOHCH_2N$ $[(C_2H_4O)C_3H_7](CH_3)_2$ $Cl^-$" should be -- $CHOHCH_2N^+[(C_2H_4O)C_3H_7](CH_3)_2$ $Cl^-$ --.

UNITED STATES PATENT OFFICE

CERTIFICATE OF CORRECTION

PATENT NO. : 4,005,030

DATED : January 25, 1977

INVENTOR(S) : David C. Heckert; David M. Watt, Jr.

It is certified that error appears in the above-identified patent and that said Letters Patent are hereby corrected as shown below:

Column 18, line 6, "$CHOHCH_2P^+(C_4H_8OH)_2CH_3$ $Cl^-$ should be -- $CHOHCH_2P^+(C_4H_8OH)_2CH_3$ $Cl^-$ --.

Column 18, line 7, "$[H(OC_4H_8)_2O](CH_3O)(CH_3O)(CH_3)SiCH_2OCH_2$" should be -- $[H(OC_4H_8)_2O](CH_3O)(CH_3)SiCH_2OCH_2$ --.

Column 18, line 9, "$[C_3H_7(OC_2H_4O](C_4H_9O](C_4H_9O)_2Si(CH_2)_2OCH_2$" should be -- $[C_3H_7(OC_2H_4O](C_4H_9O)_2Si(CH_2)_2OCH_2$ --.

Column 19, line 25, "table ware" should be -- tableware --.

Column 20, line 66, "$(CH_3O)_3SiCH_2N^+(C_2H_4OH)(CH_3)C_{12}H_{25}$ $Cl^+$" should be -- $(CH_3O)_3SiCH_2N^+(C_2H_4OH)(CH_3)C_{12}H_{25}$ $Cl^-$ --.

Column 21, line 9, "$[CH_3(OC_2H_4)_8O]_2(CH_3O)SiCH_2OCH_2CHOHCH_2N^+(C_4H_9)_3$ $Cl^-2$" should be -- $[CH_3(OC_2H_4)_8O]_2(CH_3O)SiCH_2OCH_2CHOHCH_2N^+(C_4H_9)_3$ $Cl^-$ --.

Column 21, line 9, the number 2 should be under <u>Grade</u>.

Column 21, line 36, delete EXAMPLE II , second occurrence

Column 21, line 50, delete EXAMPLE III, second occurrence

Column 21, line 64, delete EXAMPLE IV , second occurrence

Column 22, line 40, delete EXAMPLE V , second occurrence

UNITED STATES PATENT OFFICE
CERTIFICATE OF CORRECTION

PATENT NO. : 4,005,030

DATED : January 25, 1977

INVENTOR(S) : David C. Heckert; David M. Watt, Jr.

It is certified that error appears in the above-identified patent and that said Letters Patent are hereby corrected as shown below:

Column 22, line 47, "$(CH_3O)_3Si(CH_2)_3N^+(CH_3)_{2CH2}C_6H_5$ $Cl^-$" should be -- $(CH_3O)_3Si(CH_2)_3N^+(CH_3)_2CH_2C_6H_5$ $Cl^-$ --.

Column 22, line 54, delete EXAMPLE IV , second occurrence

IN THE CLAIMS

Column 25, line 19, "alky" should be -- alkyl --.

Column 26, line 19, "alky" should be alkyl --.

Column 27, line 1, "alkly" should be -- alkyl --.

Signed and Sealed this

Nineteenth Day of April 1977

[SEAL]

*Attest:*

RUTH C. MASON
*Attesting Officer*

C. MARSHALL DANN
*Commissioner of Patents and Trademarks*